US006557465B2

(12) United States Patent
Baum

(10) Patent No.: US 6,557,465 B2
(45) Date of Patent: May 6, 2003

(54) PRINTING MACHINE WITH DUAL INK APPLICATORS

(75) Inventor: Theodore M. Baum, Geneseo, IL (US)

(73) Assignee: Corrugated Gear & Services, Inc., Alpharetta, GA (US)

( * ) Notice: Subject to any disclaimer, the term of this patent is extended or adjusted under 35 U.S.C. 154(b) by 0 days.

(21) Appl. No.: 09/849,878

(22) Filed: May 4, 2001

(65) Prior Publication Data

US 2002/0113855 A1 Aug. 22, 2002

Related U.S. Application Data

(60) Provisional application No. 60/270,187, filed on Feb. 20, 2001.

(51) Int. Cl.[7] ..... B41F 5/16; B41F 31/00

(52) U.S. Cl. ..... 101/174; 101/350.6

(58) Field of Search ..... 101/247, 218, 101/351, 350.6, 174

(56) References Cited

U.S. PATENT DOCUMENTS

| | | | | |
|---|---|---|---|---|
| 2,847,214 A | | 8/1958 | Ritzerfeld et al. | |
| 3,103,125 A | | 9/1963 | Dutro et al. | |
| 3,763,775 A | | 10/1973 | Miles | |
| 4,309,945 A | | 1/1982 | Marion | |
| 4,411,194 A | | 10/1983 | Davidson, Jr. | |
| 4,565,129 A | | 1/1986 | Simeth et al. | |
| 4,614,335 A | | 9/1986 | Sardella | |
| 5,081,928 A | * | 1/1992 | Harrison | 101/351 |
| 5,154,602 A | | 10/1992 | Harrison | |
| 5,186,103 A | | 2/1993 | Gelinas et al. | |
| 5,350,348 A | | 9/1994 | Guot | |
| 5,421,258 A | | 6/1995 | Marozzi et al. | |
| 5,735,208 A | * | 4/1998 | Hummel et al. | 101/348 |
| 5,979,316 A | | 11/1999 | Baum | |
| 6,029,573 A | | 2/2000 | Capdeboscq | |
| 6,062,751 A | | 5/2000 | Baum | |
| 6,095,045 A | | 8/2000 | Peterson et al. | |
| 6,101,940 A | * | 8/2000 | Huff | 101/351.1 |
| 6,276,270 B1 | * | 8/2001 | Leanna | 101/350.6 |

FOREIGN PATENT DOCUMENTS

| | | |
|---|---|---|
| DE | 41 00 871 A1 | 7/1992 |
| DE | 9421112 | 6/1995 |
| EP | 0 468 655 A1 | 7/1991 |
| EP | 1 034 925 A1 | 9/2000 |

* cited by examiner

*Primary Examiner*—Anh T. N. Vo
*Assistant Examiner*—Manish S. Shah
(74) *Attorney, Agent, or Firm*—Michael J. Mehram; Mehrman Law Office, PC

(57) ABSTRACT

Two ink applicators, each with an ink roll and an ink chamber, for supplying ink to a print roll, and one or more applicator adjustment mechanisms for retracting one ink applicator away from the print roll while the other ink applicator contacts and supplies ink to the print roll. The applicator adjustment mechanisms has eccentric bearings and gears, a primary actuator operates each applicator adjustment mechanism, and a secondary actuator operates a travel limiting mechanism connected to the primary actuator. Alternatively, one or more actuators operate one or more pivot arms, with the ink applicators mounted thereon, for engaging or retracting the ink applicators. A main drive rotates the print roll and the ink rolls, a registration adjustment mechanism with differential gearing permits adjusting the print roll rate of rotation, and an idle drive mechanism with clutches and motors permits rotating the ink rolls independently of the main drive.

29 Claims, 23 Drawing Sheets

PRINTING MACHINE WITH DUAL INK APPLICATORS

CROSS REFERENCE TO RELATED APPLICATION

This application claims the priority benefit of U.S. Provisional Patent Application Ser. No. 60/270,187, filed Feb. 20, 2001, which is hereby incorporated by reference in its entirety.

TECHNICAL FIELD

The present invention relates to machines for printing and cutting blanks of corrugated paperboard for assembly into boxes or other structures and, more particularly, to a print-cutter machine with a modular print section having a plurality of ink applicators and a precision adjustment mechanism for the ink applicators.

BACKGROUND OF THE INVENTION

Corrugated paperboard boxes are commonly used by merchants and manufacturers for shipping and/or storing a wide range of products, from produce to electronics. These boxes are typically made from corrugated paperboard blanks that are cut and/or scored to permit folding into the shape of a box. Additionally, the blanks are usually printed with text and/or graphics relating to product identification, specifications, instructions for handling, storing, or assembly, and so forth. In order to efficiently print and cut a quantity of blanks, a printer-cutter machine is commonly utilized.

Conventional printer-cutter machines have feed rolls for drawing a blank from a stack of blanks and feeding it between an impression roll and a print roll. The print roll has a print plate with a reverse image of the desired text and/or graphics formed thereon. The position of the printing on the blank is set by the registration of the print roll, that is, by the position of a timing mark on the print roll relative to the leading edge of the blanks. An ink applicator with an ink chamber mechanism and an engraved roll applies ink to the print plate, and the ink-laden print plate prints the text and/or graphics onto the blank. Traditionally, rotary cylinder-type printing machines have employed only a single ink applicator for each print roll.

Subsequently, transfer rolls feed the blank between an anvil roll and a cutting roll with one or more cutting dies with edges extending from it for cutting the blank as desired. The feed rolls, impression roll, print roll, engraved roll, transfer rolls, anvil roll, and cutting roll are interconnected by gears or belts that are driven by a rotary power source such as an electric motor.

After processing a batch of blanks for one application, the printer-cutter machine must be reconfigured for the next printing and cutting job. With regards to cutting, normally only the cutting dies on the cutting roll need to be replaced when making different sized boxes. In that case, the cutting roll is reconfigured with different cutting dies and with a different registration in order to produce cuts of the desired length at the desired locations on the blanks. With regards to printing, there are three components of the machine that are commonly replaced or adjusted between jobs: the print plate, the print roll registration, and the ink rolls of the ink applicators.

The print plate is usually replaced in order to change the particular text and/or graphics printed onto the blanks. This involves removing the print plate from the print roll and installing a new print plate with the new text and/or graphics. Normally, this is a relatively quick and easy task.

The registration of the print roll is changed in order to print a different text and/or graphic at a different location on the blanks, when making different sized boxes. This involves changing the position of the print roll so that the timing mark is adjusted relative to the leading edge of the blanks. This is typically not an overly burdensome task but does take some time to accomplish.

Additionally, the ink rolls of the ink applicators are often reconfigured or replaced to change the color and/or grade of the printing. For some applications, particularly those including graphics, vignettes, process, and fine text and line printing (e.g. bar codes), the merchant or manufacturer wants high quality and resolution printing on the boxes. For this generally "fine" grade printing, a relatively thin layer of ink is applied to the print plate. Therefore, an engraved roll is used that has a textured surface with an ink-carrying matrix of a relatively large number of shallow cells. In other applications, heavy lines and solid figures are desired for ease of viewing the printing. For this generally "coarse" grade printing, a relatively thick layer of ink is applied to the print plate. Therefore, an engraved roll is used that has a textured surface with a matrix of a smaller number of deeper cells. Also, the printing grade can be influenced by the geometry of the cell matrix, so the engraved roll can be selected with a matrix having any of a variety of cell geometries, including hex patterns, diamond patterns, or other regular patterns or irregular textured matrices.

Thus, for each particular printing application with a desired print grade, an engraved roll with the appropriate surface matrix is installed in the machine. The appropriate surface matrix is a function of the line screen (number of cells per inch or other length), cell volume (in billions of cubic microns "BCM" or another volume unit), and cell geometry. Often, a combination of fine, coarse, or another grade of printing is provided in each print job.

In order to change out an engraved roll, the machine must be stopped and partially disassembled for access to the engraved roll. Then the engraved roll is removed and the engraved roll for the next print job installed. Finally, the machine must be reassembled and the machine restarted. This process is time consuming and typically is performed by highly trained maintenance personnel, not the machine operator.

Additionally, in order to change the ink color, the machines are typically provided with liquid lines and pumps for supplying water or another liquid to wash the ink chamber components prior to supplying a different color ink. Because only one ink applicator is provided, it cannot be used while the single ink chamber is being cleaned, so this is often done while the machine is idle between print jobs.

Thus, conventional printer-cutter machines suffer from a number of deficiencies when reconfiguring them between printing and cutting jobs:

(a) To change the print grade, the engraved roll must be changed out. For example, it is common to remove a coarse roll and install a fine roll, or vice versa, between print jobs, sometimes in order to manufacture a single batch of boxes. To access the engraved roll for change-out, the machine must be partially disassembled, the engraved roll replaced, and the machine reassembled, a process which takes a considerable amount of time.

(b) To adjust the machine for a different color printing, the engraved roll and ink chamber mechanism must be cleaned, then the different color ink supplied, sometimes adding significantly to downtime between print jobs.

(c) To change the position of the printing on the blank, the registration of the print roll must be adjusted.

The result is that between printing-cutting jobs, the printer-cutter machine operator typically stands by while maintenance personnel disassemble and reassemble the machine. With the machine disassembled, the operators replace or clean the engraved roll, clean and refill the ink chamber, and/or make any other needed adjustments. These are time-consuming, manual tasks that cannot be performed while the printer-cutter machine is in operation (without interfering with the job in progress). Therefore, the machine is often idle for a significant period of time between printing and cutting jobs while maintenance personnel and the operators make the changes necessary for the next job. For many printer-cutter machines, this downtime is on the order of about 8–10 minutes or so (for only cleaning the ink chamber) or about on hour or so (for changing out the ink roll). This downtime significantly reduces the machines effective efficiency and profitability. Additionally, having qualified personnel available to perform these involved tasks adds to labor costs.

Accordingly, there is a need for a printer-cutter machine for corrugated paperboard blanks that can be quickly and easily configured for printing the desired grades and colors at desired locations on the blanks, with little or no resulting downtime between printing and cutting jobs. Furthermore, there is a need for a machine that provides a wide variety of options in grades and colors of printing so that the engraved roll rarely if ever needs to be changed-out.

SUMMARY OF THE INVENTION

The present invention meets the aforementioned needs by providing a printer-cutter machine that can be refitted for a subsequent printing-cutting job with a downtime typically on the order of about 1–2 minutes or less. The machine has two (or more) ink applicators for each print roll, with each ink applicator having an engraved roll and an ink chamber mechanism. Each print roll can be provided with the associated ink applicators each having engraved rolls with different textured surface matrices and with ink chambers having different colors of ink, so that the ink applicators need to be refitted less often.

For example, one ink applicator can be fitted with an engraved roll having a fine textured surface for high quality graphics printing and the other ink applicator can be fitted with a coarse textured engraved roll for large, bold printing. As a further example, one of the ink applicators can supply black ink to the print roll and another ink applicator can supply red ink. Additional print rolls and ink applicators can be provided, for example, four print rolls each having two ink applicators, thereby providing eight colors of ink available for printing. The invention thus provides the advantage of a wide variety of readily available printing options, both in print quality and color, so that the ink applicators rarely if ever need to be refitted with a different engraved roll or color of ink.

Furthermore, because the machine has two ink applicators for each print roll, one of the ink chambers can be cleaned and refilled with a different color ink while the other ink chamber is in use. This provides the advantage of retracting and refitting one of the ink applicators for a different color of ink for the next print job while the machine is in operation, instead of between jobs with the machine idle.

Additional features of the invention provide the advantage of more efficiently and precisely adjusting the position of the multiple ink applicators, because each ink applicator is now moved between an engaged "in use" position and a retracted "out of use" position. In order to quickly and easily move the ink applicators, each ink applicator can be provided with an applicator adjustment mechanism and an incremental actuator for selectively operating the applicator adjustment mechanism in increments or steps. Thus, by actuating the actuator, the corresponding ink applicator can be quickly and easily moved toward and into a precise position of contacting engagement with the print roll, or retracted away from and out of contacting engagement with the print roll, independent of the other ink applicator. Also, the ink wells may have pivotal mountings so that when the ink applicators are retracted, the ink wells can be easily swiveled to the side for providing access for quick and easy cleaning and maintenance of the ink wells.

Additionally, the machine can be provided in a modular arrangement with a modular feed section, one or more modular print sections, and a modular cutter section, each separably coupled together. Any number of modular print sections can be provided, for example, four of the print sections can be operatively connected together in series with the feed section and the cutter section. The print sections and the feed section and/or cutter section are mounted so that the print sections can be rolled or otherwise moved apart from each other after they are decoupled. This provides the advantage of easy access to the ink applicators and other components for maintenance, and the ability to add, remove, or retrofit entire print sections as may be desired.

Moreover, the present machine includes a print registration adjustment mechanism that allows for efficiently adjusting the registration of the print roll. When the print roll becomes out of registration or before printing a batch of blanks having a different size, a registration adjustment gearmotor can be actuated to selectively drive a differential gear-set and adjust the position of the timing mark on the print roll relative to the leading edge of the blanks, independent of the main drive for the machine. The result is that the print registration can be easily monitored and adjusted, so that the printing is always applied at the desired location on the blank.

Generally described, the invention is a machine for operating on blanks, for example, for performing printing and cutting operations on corrugated paperboard blanks for assembly into boxes. In this configuration, the machine has a feed mechanism, a print mechanism, a cutter mechanism, and a rotary main drive. The feed mechanism has two rotary feed rolls that draw the blanks from a stack of blanks into the machine and transport the blanks in series through the machine.

The print mechanism has a rotary impression roll, a rotary print roll, and at least one ink applicator. The impression roll and the print roll are positioned proximate to each other so that the space between them provides a nip for receiving the blanks in series. Any of a variety of print plates can be mounted onto the print roll, with each print plate having a reverse image of the desired text and/or graphics. Each ink applicator has an ink chamber mechanism and a rotary engraved roll, with the ink chamber mechanism supplying ink to the engraved roll which in turn applies the ink to the print plate. The ink-laden print plate then prints the text and/or graphics onto the blank passing through the nip.

A vacuum transfer mechanism having rotary transfer rollers advances the printed blanks to the cutter mechanism. The cutter mechanism has a rotary anvil roll and a rotary cutting roll with cutting blades attached to it for cutting the blanks as desired, for example, to form flaps for folding into a box.

The main drive rotationally drives the feed mechanism, the print mechanism, and the cutter mechanism. Accordingly, the main drive has a rotary power source such as an electric motor that is operatively connected to one or more of the feed rolls, which is operatively connected to a rotary transmission shaft, which is operatively connected to the impression roll, the print roll, the engraved rolls, transfer rolls, the anvil roll, and the cutter roll.

According to one aspect of the invention, the machine can have two (or more) ink applicators for each print roll. Additional ink applicators can be provided for each print roll as may be desired in a given situation. Each of the engraved rolls can have a different surface texture, for example, one engraved roll for "fine" grade printing might have a textured surface with an ink-carrying matrix of a relatively large number of shallow cells. Another engraved roll for "coarse" grade printing might have a surface matrix of a smaller number of deeper cells. Of course, other engraved rolls with other textured surface matrices can be provided for producing the desired print grade.

Additionally, each ink chamber mechanism can have a support member, an ink well coupled to the support member for storing the ink, and two or more doctor blades extending from the ink well and contacting the engraved roll for applying the ink to the engraved roll. The ink wells can be coupled to the corresponding support member by a pivotal coupling, and the support members can be coupled to the corresponding engraved roll or other component so that the ink chamber mechanism and the engraved roll move together. Also, an ink chamber adjustment mechanism with at least one flexible tube can be provided for each ink chamber mechanism, for inflating and deflating the tube or tubes to move the ink chambers between an engaged position with the corresponding engraved roll and a retracted position.

Another aspect of the invention is an applicator adjustment mechanism for precisely moving each ink applicator, and actuators for quickly and easily operating each applicator adjustment mechanism. For example, each applicator adjustment mechanism can have two eccentric bearings for rotationally mounting the corresponding ink applicator to the machine, with the engraved roll axles off-center of the bearing axis so that rotating the eccentric bearings causes the ink applicator to move toward or away from the corresponding print roll independent of the other ink applicator. Also, each applicator adjustment mechanism can have an adjustment shaft with spur gears that drive spur gears on the eccentric bearings for rotating the eccentric bearings, a primary rotary actuator for rotating the adjustment shaft, a travel limiting mechanism for adjusting the rotational range limits of the primary actuator, and a secondary incremental actuator for incrementally adjusting the travel limiting mechanism. Thus, the ink applicators can be incrementally moved into the precise engaged position desired, or moved to the retracted position.

Alternatively, each applicator adjustment mechanism can have one or more pivot arms and actuators. The ink applicators are mounted on the pivot arms so that, upon operation of the actuator, the ink applicators pivot between the engaged and retracted positions. Additionally, the applicator adjustment mechanisms can include stops with eccentric cams for limiting and adjusting the pivotal travel of the pivot arms and ink applicators.

In a further aspect of the invention, the machine can be provided with a modular feed section, one or more modular print sections, and a modular cutter section. The modular feed section includes the feed mechanism and the feed drive supported by a feed section frame, the modular print sections each include one (or more) of the print mechanisms and one (or more) of the print drives supported by a print section frame, and the modular cutter section includes the cutter mechanism and the cutter drive supported by a cutter section frame. The feed drive transmission shaft is rotationally driven by the feed rolls, each print drive transmission shaft rotationally drives the corresponding print roll, impression roll, and engraved rolls, and the cutter drive transmission shaft rotationally drives the cutter roll and the anvil roll.

Any number of modular print sections can be provided, for example, four of the print sections can be operatively connected together in series with the feed section and the cutter section. The transmission shaft of each print section has an input end that can be separably coupled to an output end of the feed section transmission shaft (for the first print section) or to an output end of a preceding print section transmission shaft (for the second or third print section). Similarly, each print section transmission shaft of has an output end that can be separably coupled to an input end of the cutter section transmission shaft (for the fourth print section) or to an input end of another print section transmission shaft (for the second or third print section). The separable couplings can be provided by a spline-type coupling or another separable coupling permitting quick and easy disconnection of the transmission shafts. Additionally, the machine can have a track and roller bearings riding on the track and supporting the print section frames and the feed or cutter frame, so that the print sections can be rolled apart from each other after they are decoupled, for access to the ink applicators and other components for maintenance.

Accordingly, the machine can be employed in a method for retrofitting a pre-existing printer-cutter machine to provide increased printing options, where the pre-existing printer-cutter machine has a feed section, print section, and cutter section, each with a transmission shaft. In particular, the method comprises the steps of decoupling the transmission shaft of the pre-existing print section from the transmission shaft of the adjacent feed section or cutter section, and removing the pre-existing print section from adjacent the feed section and the cutter section. The method further comprises the steps of providing at least one print section having a rotary print roll, at least two ink applicators for each print roll, and a transmission shaft, wherein each ink applicator has an engraved roll and an ink chamber mechanism, disposing the print section adjacent the feed section or the cutter section, aligning the transmission shaft of the print section with the transmission shaft of the adjacent feed section or the transmission shaft of the adjacent cutter section and coupling the transmission shaft of the print section with the transmission shafts of the adjacent feed, print, and/or cutter section.

In still another aspect of the invention, each print drive can be connected to a registration adjustment mechanism. The registration adjustment mechanism has a differential gear-set that is operatively connected to a gearmotor and to the print roll, and that is selected so that actuation of the gearmotor changes the rate of rotation of the print roll. Thus, the print roll rate of rotation, which is controlled by the print drive, can be changed by actuation of the gearmotor.

In view of the foregoing, it will be appreciated that the present printer-cutter machine provides a substantial improvement over the prior art by producing a significant reduction in downtime between printing-cutting jobs. The specific techniques and structures employed by the invention to improve over the drawbacks of the prior systems and accomplish the advantages described above will become apparent from the following detailed description of the embodiments of the invention and the appended drawings and claims.

DETAILED DESCRIPTION OF THE EXEMPLARY EMBODIMENTS

Figure 1:
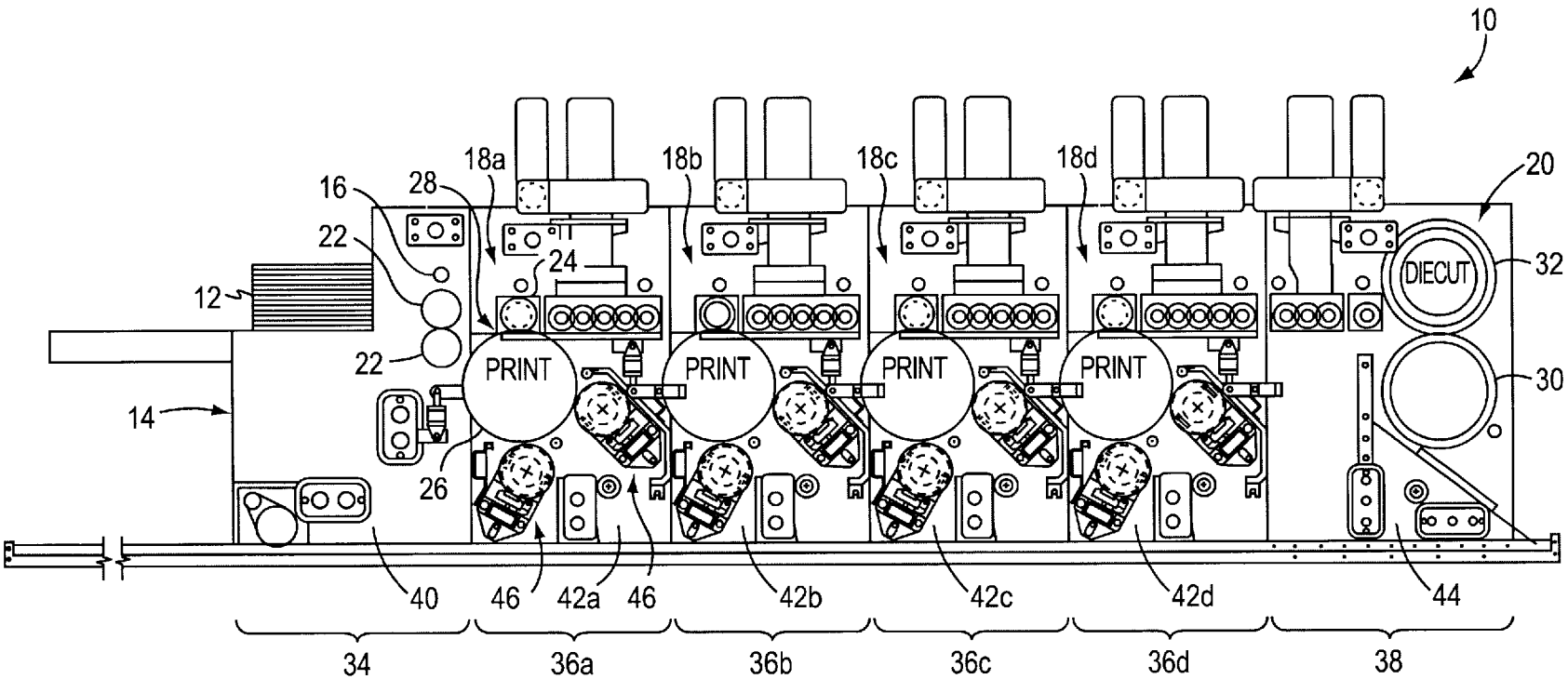
FIG. 1 is a longitudinal cross sectional view through an exemplary printer-cutter machine according to the present invention, showing a feed section, four print sections, and a cutter section.

Referring now to the drawings, FIG. 1 illustrates an exemplary embodiment of the present invention, referred to generally as printer-cutter machine 10. The machine 10 operates on blanks 12 made of materials such as corrugated paperboard, plastic, wood, fiberglass, fabric, composites, and so forth. While the embodiment described herein is a printer-cutter machine for printing and cutting the blanks, the invention can be embodied in a machine that only prints on the blanks. Also, the machine can be adapted for performing other operations on the blanks, such as painting, applying a film layer, affixing labels, folding, bending, perforating, scoring, and so forth.

The machine 10 has a machine frame 14, a feed mechanism 16, four print mechanisms 18*a*–18*d* (collectively the "print mechanisms 18"), and a cutter mechanism 20. The feed mechanism 16 has two or more rotary feed rolls 22 that are rotationally mounted to the frame 14 by, for example, rotary bearings. The feed rolls 22 rotate in opposite directions, draw the blanks 12 from a stack of blanks into the machine 10, and feed the blanks 12 in series to the print mechanisms 18.

The print mechanisms 18 each have an impression member such as rotary impression roll 24, and a rotary print roll 26, which are each mounted to the frame 14 by, for example, rotary bearings. A print plate 27 can be removably mounted to the print roll 26 for printing the desired text and/or graphics for a particular print job. The space between the impression roll 24 and the rotary print roll 26 forms a nip 28 for receiving the blanks 12 in series.

The cutter mechanism 20 has a rotary anvil roll 30 and a rotary cutter roll 32 that are mounted to the frame 14 by, for example, rotary bearings. The blanks 12 are cut by the cutter roll 32 as the blanks 12 pass through the nip between anvil roll 30 and the cutter roll 32.

The nip 28 of the print mechanism 18, the nip of the cutter mechanism 20, and the nip of the feed mechanism 16 are adjusted by conventional nip adjustment mechanisms known in the art. Also, the feed mechanism 16, the print mechanism 18, and the cutter mechanism 20, can be driven by a rotary drive with sprockets and chained belts, by one or more gear trains, by a combination thereof, or by another drive assembly know in the art. An example of a belt-driven printer-cutter machine having a similar feed mechanism, cutter mechanism, impression roll, print roll, and nip adjustment mechanisms, with a detailed description of its components, manufacture, and operation, is provided by U.S. Pat. No. 6,062,751 to Baum, which is hereby incorporated by reference in its entirety.

In the present exemplary embodiment, the machine 10 is provided with the feed mechanism 16, the print mechanisms 18, and the cutter mechanism 20 each included in a modular feed section 34, modular print sections 36*a–d* (collectively the "print sections 36"), and a modular cutter section 38, respectively. Accordingly, the modular feed section 34 includes the feed mechanism 16 rotationally driven by a rotary feed drive 35 (see FIG. 6) and independently mounted to a feed section frame 40 of the machine frame 14. Similarly, the modular print sections 36 include the print mechanisms 18 which are rotationally driven by rotary print drives 37*a*–37*d* (collectively the "print drives 37") (see FIG. 6), and independently mounted to print section frames 42*a–d* (collectively the "print section frames 42") of the machine frame 14. Furthermore, the modular cutter section 38 includes the cutter mechanism 20 rotationally driven by a rotary cutter drive 39 (see FIG. 6), and independently mounted to a cutter section frame 44 of the machine frame 14.

Alternatively, the machine 10 can be provided with the feed mechanism 16, the print mechanism 18, and the cutter mechanism 20 rotationally driven by a rotary main drive with only one or another number of belts or gear trains, and mounted to a unitary machine frame, as is known in the art. Also, the machine 10 can be provided with only the feed mechanism 16 and the print mechanism 18, with only the feed mechanism 16 and the cutter mechanism 20, with the feed mechanism 16 and/or the print mechanism 18 in combination with other machine sections for performing other operations on the blanks 12, and in other sequences such as arranging the cutter mechanism 20 before the print mechanism 18. Furthermore, although four of the print sections 36 are provided in this exemplary embodiment, any number of the print sections 36 can be suitably employed, as may be desired in a given application.

Figure 1A:
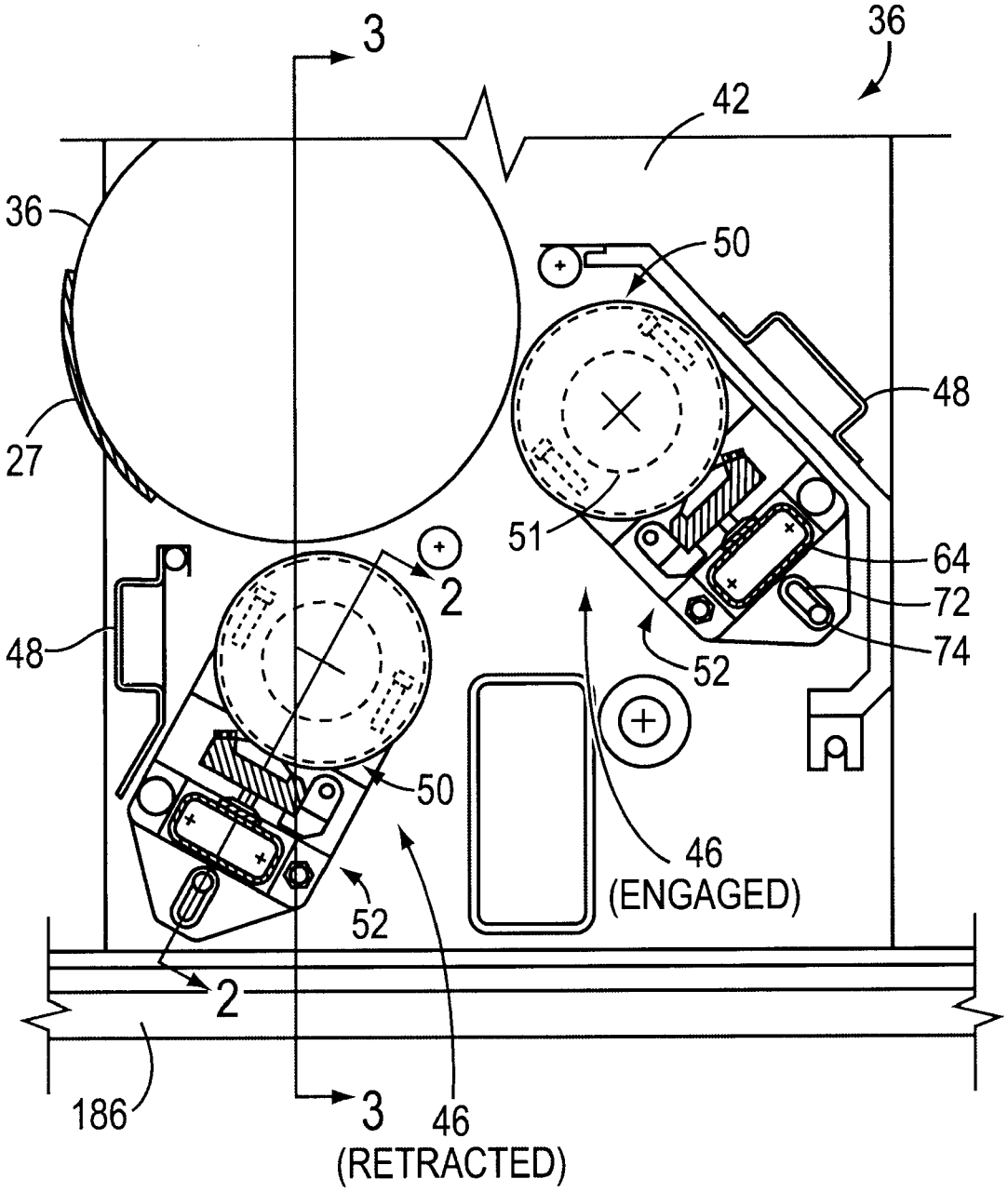
FIG. 1A is a detail view of a lower portion of one of the print sections of FIG. 1, showing two ink applicators and a print roll.

Referring now to FIG. 1A, each of the print sections 36 has two ink applicators 46. Each ink applicator 46 has a rotary ink roll such as engraved roll 50, and an ink chamber mechanism 52 for supplying ink to the engraved roll. The engraved rolls 50 each have an axle 51 and rotate in a direction opposite to the print roll 26, thereby transferring ink to the rotary print roll 26. An ink applicator guard 48 can be mounted to the print section frame 42 adjacent to each ink applicator 46.

Each ink applicator 46 is mounted proximate to the corresponding print roll 26 to which it applies ink. Proximate in this instance means that each ink applicator 46 is positioned sufficiently close to the print roll 26 so that the ink applicators 46 can be moved between an "engaged" position contacting the print roll 26 and a "retracted" position not in contact with the print roll 26. Of course, additional ink applicators 46 can be provided for each print roll 26, as may be desired in a given application for providing additional printing color and grade options. The machine 10 thereby can be configured with four (or another number) of print sections 36 each having two (or more) ink applicators 46. This arrangement permits a wide variety of printing options by a single machine 10 without refitting the ink applicators.

Figure 1B:
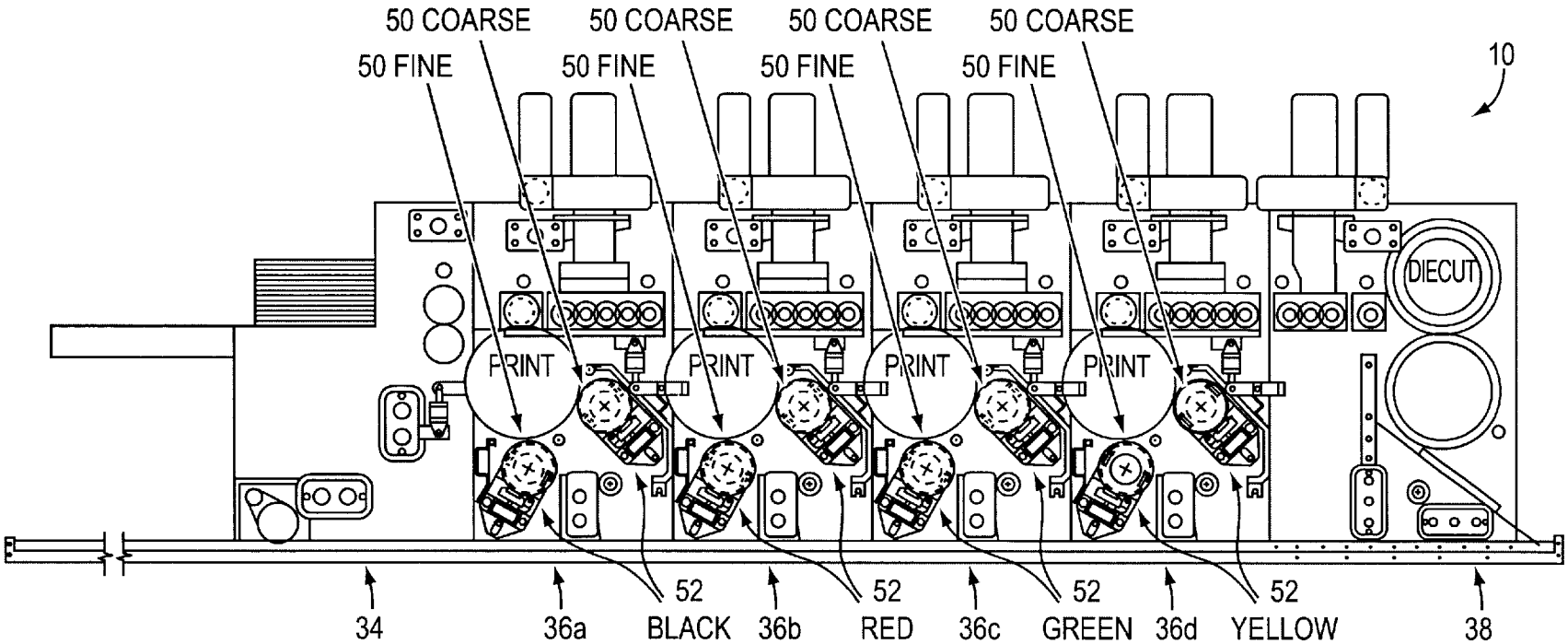
FIG. 1B shows the printer-cutter machine with the ink applicators of the print sections configured in an exemplary arrangement.

For example, as shown in FIG. 1B, the machine 10 can be configured with each of the print sections 36 having one ink applicator 46 with a fine grade engraved roll 50 and another ink applicator with a coarse grade engraved roll. Each print section can have an ink chamber 52 with a different color of ink such a black, red, green, yellow, and/or another color. Such an arrangement provides the option of printing any or all of the primary colors, in either of two different print grades (where only one engraved roll is engaged at a time), in a single run of blanks 12 through the machine 10 without having to change out any engraved rolls.

Thus, for one print job, all four print sections 36*a–d* can have an ink applicator engaged. For instance, black and red can be printed in a fine grade by print section 36*a* and 36*b*, while green and yellow are printed in a coarse grade by print section 36*c* and 36*d*, all in one pass through the machine 10.

For the next print job, only one or another number of print sections 36 might have an ink applicator 46 engaged. For instance, one of the ink applicators 46 of print section 36*a* can be engaged for printing black in a coarse grade for one print job. Then for the next print job, that black ink applicator can be retracted and another of the ink applicators of another print section 36*b* having a red ink and a fine grade engraved roll can be engaged, without having to replace any engraved rolls 50.

Figure 1C:
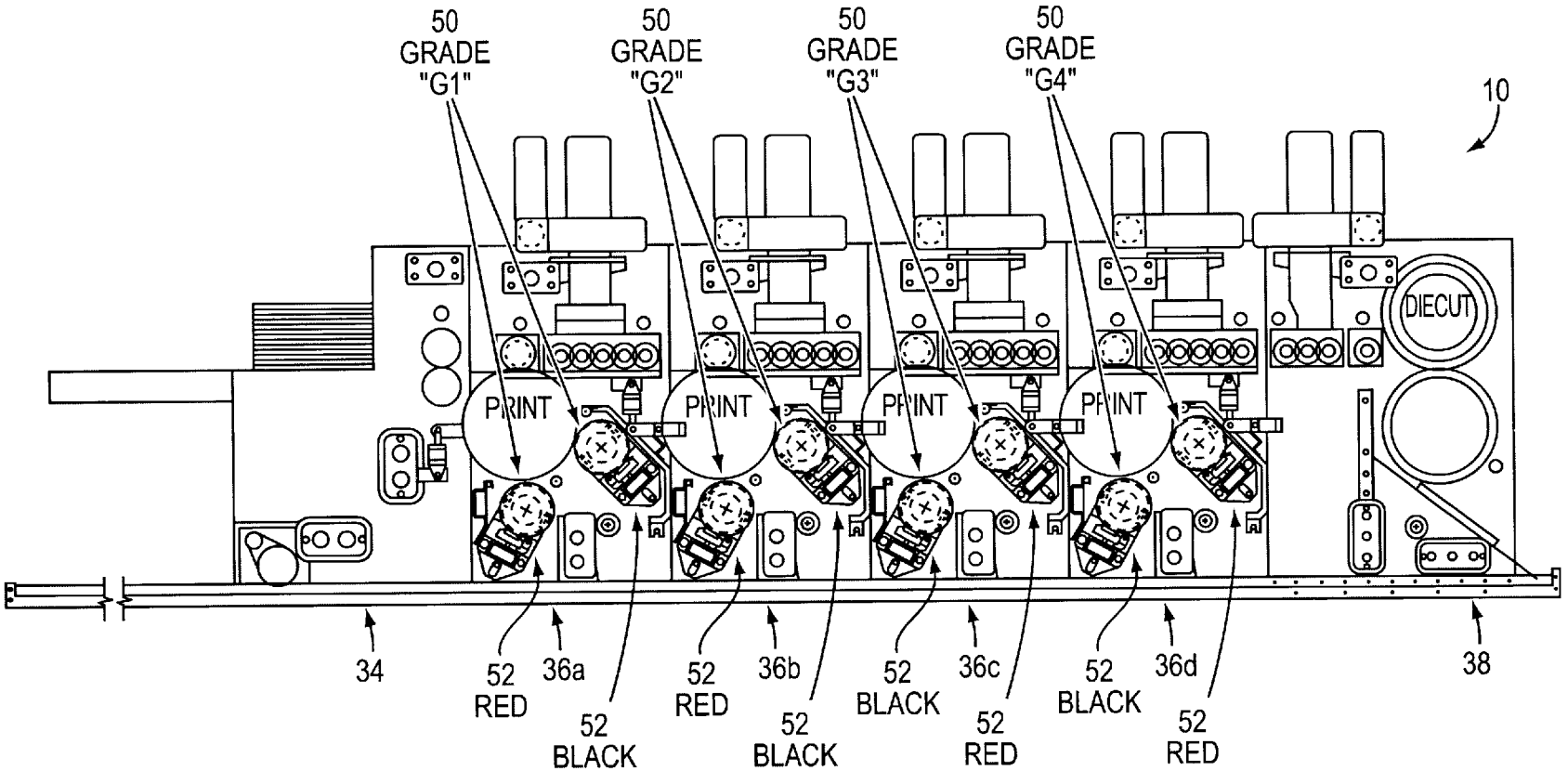
FIG. 1C shows the printer-cutter machine with the ink applicators of the print sections configured in another exemplary arrangement.

In another example, as shown in FIG. 1C, the machine 10 can be configured with each of the print sections 36 having one ink applicator 46 with an ink chamber 52 having one color of ink such black, and another ink applicator with an ink chamber having another color of ink such a red. Each print section 36 can have engraved rolls 50 with different surface matrices (i.e., different line screens, cell volumes, and/or cell geometries, and so forth) for producing different print grades, as described above. For instance, the first print section 36*a* can have engraved rolls 50 of a first grade "G1" for printing very finely detailed images and vignettes, the second print section 36*b* can have engraved rolls of a second grade "G2" for printing images and fine vignettes, the third print section 36*c* can have engraved rolls of a third grade "G3" for printing intermediate thickness lines and text, and the fourth print section 36*d* can have engraved rolls of a fourth grade "G4" for printing heavy lines and solids. Such an arrangement provides the option of printing two different print colors in a four different print grades during one pass through the machine, without having to change out engraved rolls.

Thus, for one print job, all four print sections 36*a–d* can have an ink applicator 46 engaged. For instance, black can be printed in grades G1, G2, and G4, by print sections 36*a*, 36*b*, and 36*d*, respectively, while red is printed in grade G3 by print section 36*c*, all in one pass through the machine.

For the next print job, only one or another number of print sections 36 might have an ink applicator 46 engaged. For instance, one of the ink applicators 46 of print section 36*d* can be engaged for printing black in grade G4 for bold lettering. Then for the next print job, that coarse grade G4 ink applicator can be retracted and another one of the ink applicators of print section 36*a* having a red ink and a fine grade G1 engraved roll can be engaged, without having to replace an engraved roll.

Of course, the configurations shown in FIGS. 1B and 1C are only two of many possible machine configurations. Each machine 10 can be configured with the number of print sections 36 and the grade of engraved rolls 50 for each print section selected based on the type of printing typically done in each application. Because of the wide variety of available printing options provided, the engraved rolls 50 rarely if ever need to be changed out. Therefore, the machine 10 can be set up quickly and easily for a subsequent print job simply by retracting and/or engaging the appropriate ink applicators 46 to produce the desired print color and grade.

Figure 2G:
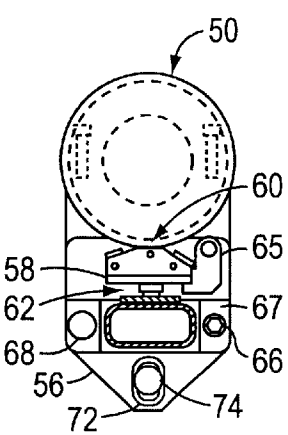
FIG. 2G is a cross sectional view through the ink applicator taken along line 2A—2A of FIG. 2, showing the adjusted position of the ink well after wear of the doctor blades of the ink chamber.
Figure 2A:
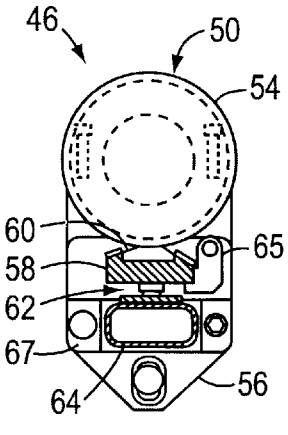
FIG. 2A is a cross sectional view through the ink applicator taken along line 2A—2A of FIG. 2.
Figure 2E:
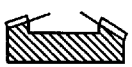
FIG. 2E is a cross sectional view through the ink well taken along line 2E—2E of FIG. 2B.
Figure 2F:
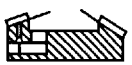
FIG. 2F is a cross sectional view through the ink well taken along line 2F—2F of FIG. 2B.
Figure 2C:
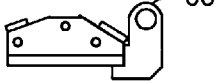
FIG. 2C is a cross sectional view through the ink well taken along line 2C—2C of FIG. 2B.
Figure 2D:
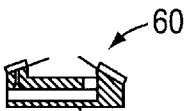
FIG. 2D is a cross sectional view through the ink well taken along line 2D—2D of FIG. 2B.
Figure 2:
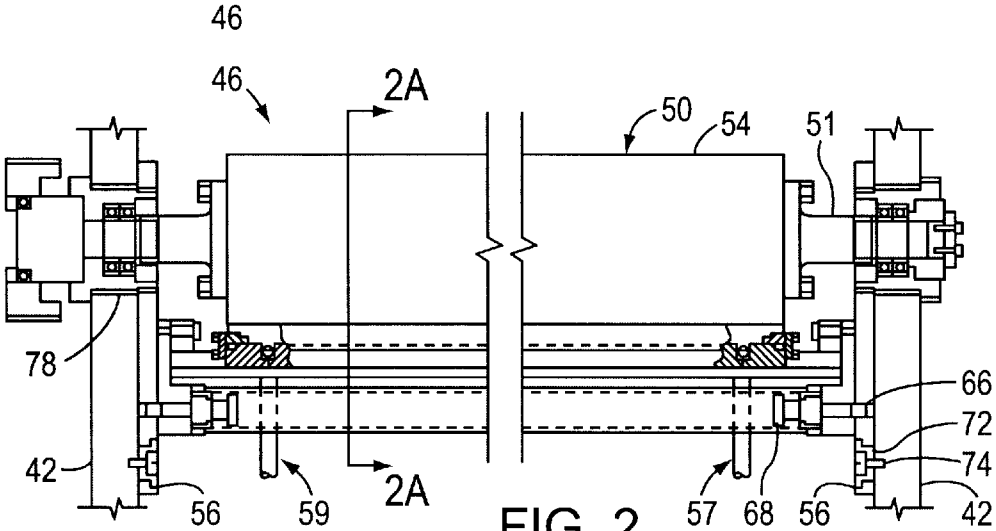
FIG. 2 is a cross sectional view through the ink applicator taken along line 2—2 of FIG. 1B, showing an engraved roll and an ink chamber mechanism.

Referring now to FIGS. 2 and 2A, each engraved roll 50 has a textured surface 54 for receiving ink from the ink chamber mechanism 52 and applying the ink to the print plate 27. For example, the textured surface can be provided by an ink-carrying cell matrix as described above so that ink supplied from the ink chamber mechanism 52 can accumulate in the cells of the surface matrix for transfer to the print roll 26. For example, engraved rolls 50 having surfaces 54 with relatively shallow cells can be used to apply a relatively thin layer of ink for producing fine grade printing such as graphics and bar codes. Conversely, engraved roll surfaces 54 with relatively deep recesses can be used to apply a relatively thick layer of ink for producing relatively dense, bold, printing. The engraved rolls 50 can be made of or coated with a ceramic, or optionally can be made of or coated with a rubber, polymer, metal, composite, or other material known in the art and selected for the particular application. Suitable engraved rolls are commercially available, such as the ANILOX™ rolls made by the Harper Corporation of America, of Charlotte, N.C.

Figure 2B:
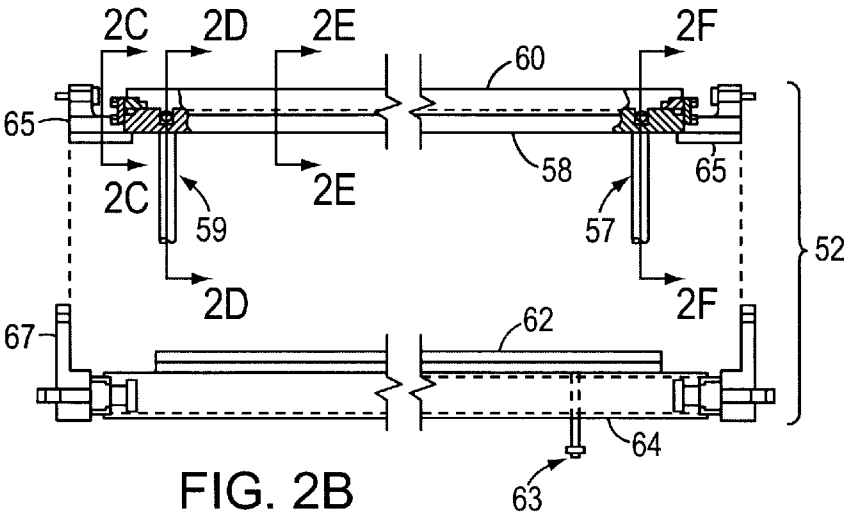
FIG. 2B is an exploded view of the ink chamber mechanism of FIG. 2, showing the ink well and other components of the ink chamber.

Referring to FIGS. 2, 2A, and 2B, the ink chamber mechanisms 52 each have a support member such as support plate 56, a base member 64 coupled to the support plate 56, an ink well 58 coupled to the base member 64, and two or another number of doctor blades 60 extending from the ink well 58 generally towards the corresponding engraved roll 50. The ink well 58 can be provided by an elongate U-shaped bar made of metal (see FIGS. 2C–2F). Alternatively, the ink well 58 can be provided by a length of channel, a housing with a slit, or another structure that can hold ink in a recessed portion thereof, and which is made of a metal, plastic, glass, fiberglass, ceramic, composite, or other material. The blades 60 are semi-rigid with sufficient flexibility so that they can deflect to prevent getting caught in the textured recesses of the engraved roll surfaces 54. Thus, the blades 60 can be made of a polyethylene, or optionally can be made of a metal, plastic, elastomer, fiberglass, composite, or other material. The leading blade 60 contains the ink in the chamber and the trailing blade doctors ink from the surface of the print roll 26, except for the ink left in the engraved cells. The base member 64 can be provided by a tube, bar, block, or the like, that is made of a metal, plastic, composite, or other material.

Figure 11:
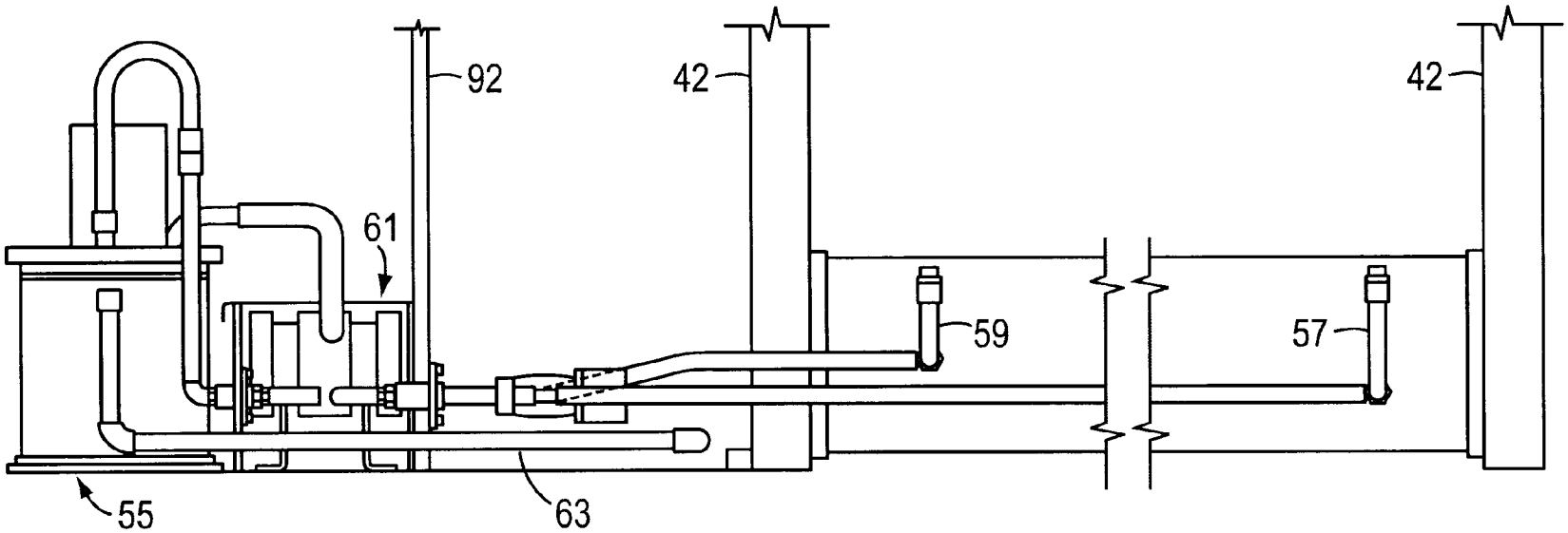
FIG. 11 is a left side view of the machine showing the ink and water supply lines.

The ink can be supplied to the ink wells 58 by an ink inlet line 57 connected to an ink reservoir 55 (see FIG. 11). Ink can flow from the reservoir to the ink well 58 by the use of a pump 61 (see FIG. 11) or by gravity where the reservoir is positioned above the ink wells 58. Also, an ink outlet line 59 can be connected to the ink well 58 for cycling or draining the ink from the ink well. Valving and metering (not shown) can be provided in the ink inlet and/or outlet lines 57 and 59, as may be desired. Additionally, water or other fluid lines 63 (see FIG. 11) can be connected to the ink lines to provide for cleaning the ink applicators. This ink and water supply arrangement is well known in the art of printer-cutter machines. Alternatively, the ink chamber mechanisms 52 can be provided with replaceable ink cartridges that insert into and supply ink to the ink wells 58, or the ink chamber mechanisms 52 themselves can be provided by ink cartridges with ink application pads, blades, or the like.

Additionally, the ink chamber mechanisms 52 can each have an adjustment mechanism for moving the corresponding ink chamber mechanism 52 between an engaged position with the corresponding engraved roll 50 and a retracted position. Each adjustment mechanism can include a generally flexible tube 62 mounted on the base member 64 and supporting the ink well 58. A fluid line 63 for delivering pressurized air or another fluid is connected to the flexible tube 62. The tube 62 can be selectively inflated to bias the ink well 58 and blades 60 against the corresponding engraved roll 50 as desired. Accordingly, the flexible tube 62 can be made of an elastomer, plastic, composite, or other material suitable for carrying pressurized air.

Referring to FIG. 2G, as the blades 60 wear from use, the flexible tube 62 expands with generally constant air pressure to adjust the position of the blades 60 to maintain proper contact pressure with the engraved roll 50. Because the blades 60 are often arranged at different angles relative to the engraved roll 50, they wear at different rates. To account for this, a pivotal member such as pivot arm 65 can support the ink well 58 and be pivotally mounted to the support plate 56 by a pivotal coupling as is known in the art. The ink well 58 is thereby permitted to pivot so that both blades 60 can be maintained with proper pressure of contact with the engraved roll 50. As shown in this figure, when the blades 60 are worn down from use, the flexible tube 62 expands and the ink well 58 is pivoted by the pivot arm 65 to keep the worn blades 60 in contact with the engraved roll 50.

The ink well 58 and base 64 are mounted to a pivot plate 67 that is pivotally coupled to the corresponding support plate 56 by a pivotal coupling 66 such as a pin, rivet, dowel, bolt, screw, or other fastener permitting a pivotal motion. A lock secures the pivot plate 67 in place on the support plate 56. For example, the lock can be provided by a removable lock pin 68 inserted through aligned apertures in the pivot plate 67 and the support plate 56. When the lock pin 68 is removed, the pivot plate 67 can be pivoted about the pivotal coupling 66 and to the side to provide access to the ink well 58 for cleaning and maintenance. Alternatively, the lock can be provided by a removable lock pin or the like inserted through an aperture in the support plate 56 and abutting the pivot plate 67, or by a clamp, pivotal arm, flange, or hook, or other lock mechanism.

The mounting of the ink chamber 52 allows the ink applicator to move toward or away from the print roll 26. Accordingly, each support plate 56 is rotationally coupled to an eccentric bearing 78 (see FIG. 2) or another bearing supporting the corresponding engraved roll 50. The rotational coupling can be provided by, for example, a bushing, rotational bearing, or another coupling, so that the ink chamber 52 can be moved into the engaged or retracted position together with the rotating engraved roll 50. Alternatively, the support plate 56 can be rotationally coupled to the engraved roll axle 51, the machine frame 42, or another component of the machine.

Additionally, the ink chamber mechanism 52 is slidably coupled to the print section frame 42 so that the ink applicator 46 is permitted to slide toward and away from the print roll 26. For example, the support plate 56 can have a slot 72 defined therein and the print section frame 42 can have a post 74 extending through the slot 72, so that the support plate 56 can slide relative to the frame 42 (see FIG. 1A). Alternatively, a slot can be defined in the frame and a post can extend from the plate, or other slidable mounting arrangements can be provided.

Figure 2H:
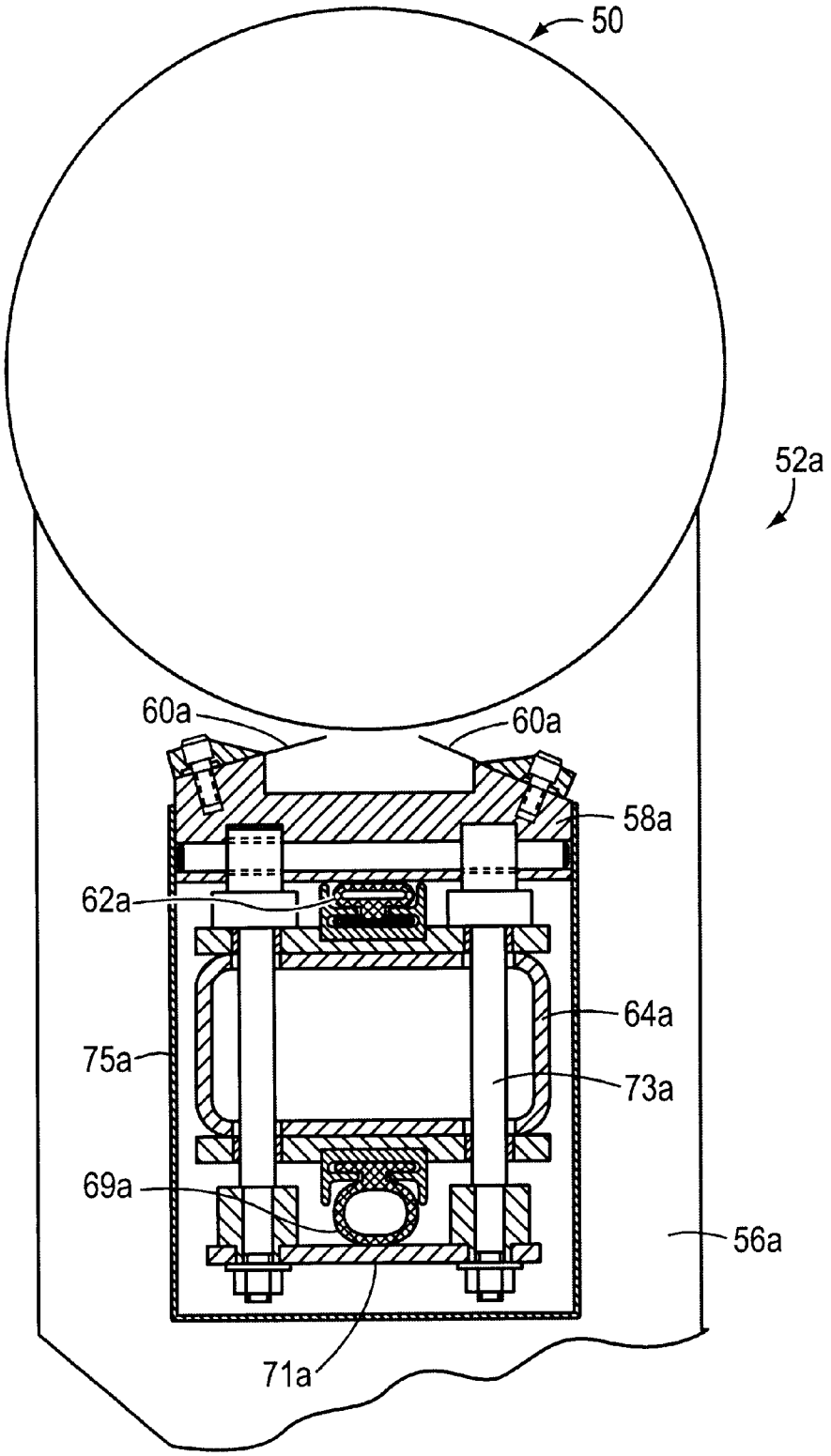
FIG. 2H is a cross sectional view through an alternative ink applicator, showing a linearly adjusted alternative ink chamber mechanism in a retracted position.
Figure 2I:
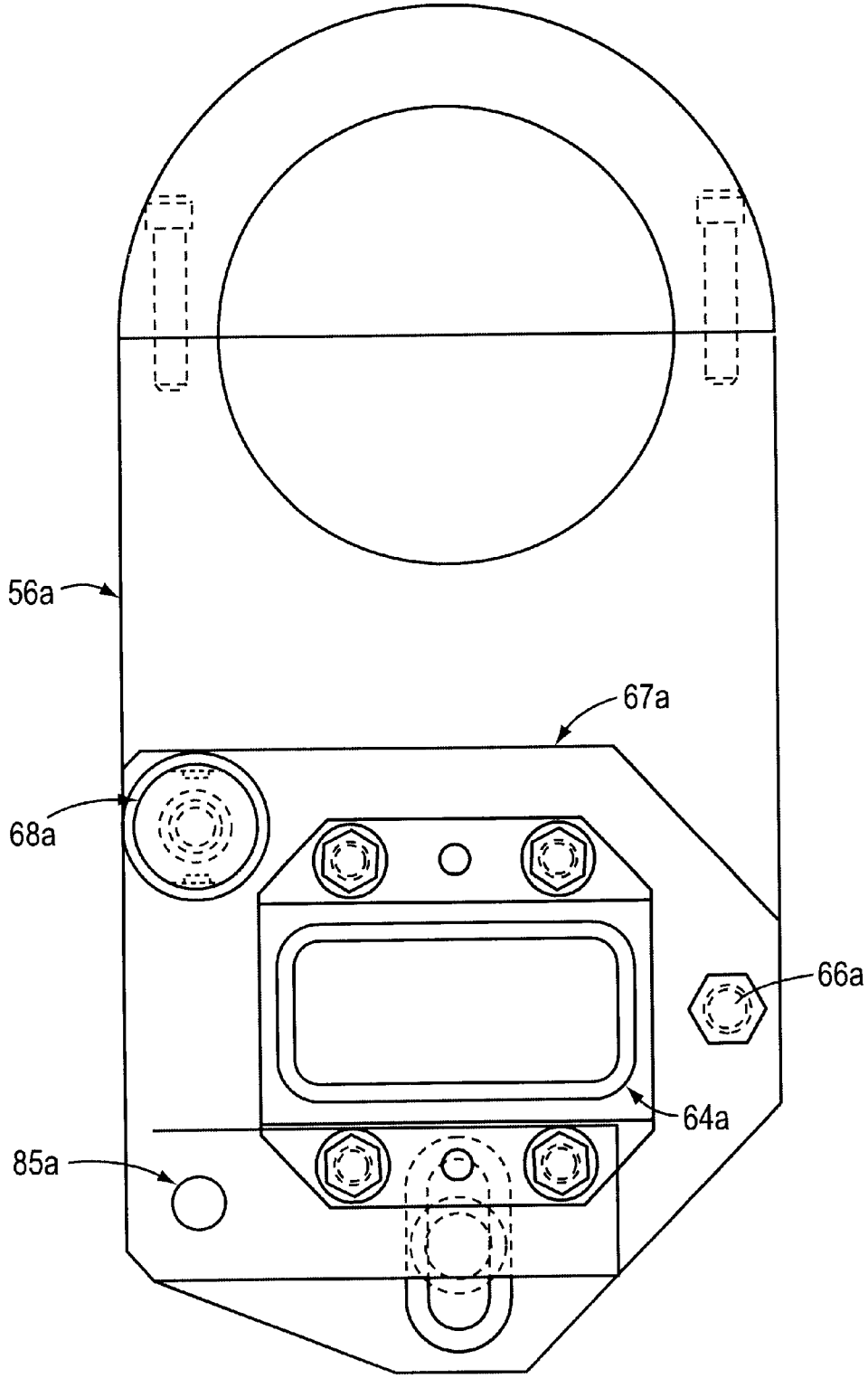
FIG. 2I is a cross sectional view of a support plate of the ink applicator of FIG. 2H.

Referring now to FIGS. 2H and 2I, there is shown an alternative ink chamber mechanism 52*a* that can be linearly adjusted for selectively applying ink to the engraved roll 50. Similar to the ink chamber mechanism 52, the alternative ink chamber mechanism 52*a* has a support member 56*a* (see FIG. 2H), a base member 64*a* coupled to the support member 56*a*, an ink well 58*a* coupled to the base member 64*a*, and an ink chamber adjustment mechanism such as a first inflatable flexible tube 62*a* disposed between the ink well 58*a* and the base member 64*a*. The base member has a first side 53*a* and a second side 55*a* that is opposite the first side 53*a*, and the first tube 62*a* is disposed adjacent the first side 53*a*. Also, the support plate 56*a* can have a stop hole 85*a* defined therein for receiving the lock pin 68*a* when the pivot plate 67*a* is pivoted about the pivot point 66*a* for cleaning and maintenance of the ink well 58*a*. Additionally, the ink chamber adjustment mechanism can include a linear guide mechanism having a guide plate 71*a* disposed adjacent the second side 55*a*, a second inflatable flexible tube 69*a* that is disposed between the second side 55*a* and the guide plate 61*a*, and one or a number of guide posts 73*a* coupled to the ink well 58*a* and the guide plate 71*a* and extending through the base member 64*a*. Any number of guide posts 73*a* can be provided, for example, four pairs of guide posts 73*a* have proven suitable. A housing can be provided for the base member 64*a*, first tube 62*a*, guide plate 71*a*, second tube 69*a*, and the guide posts 73*a*, as may be desired.

Figure 2J:
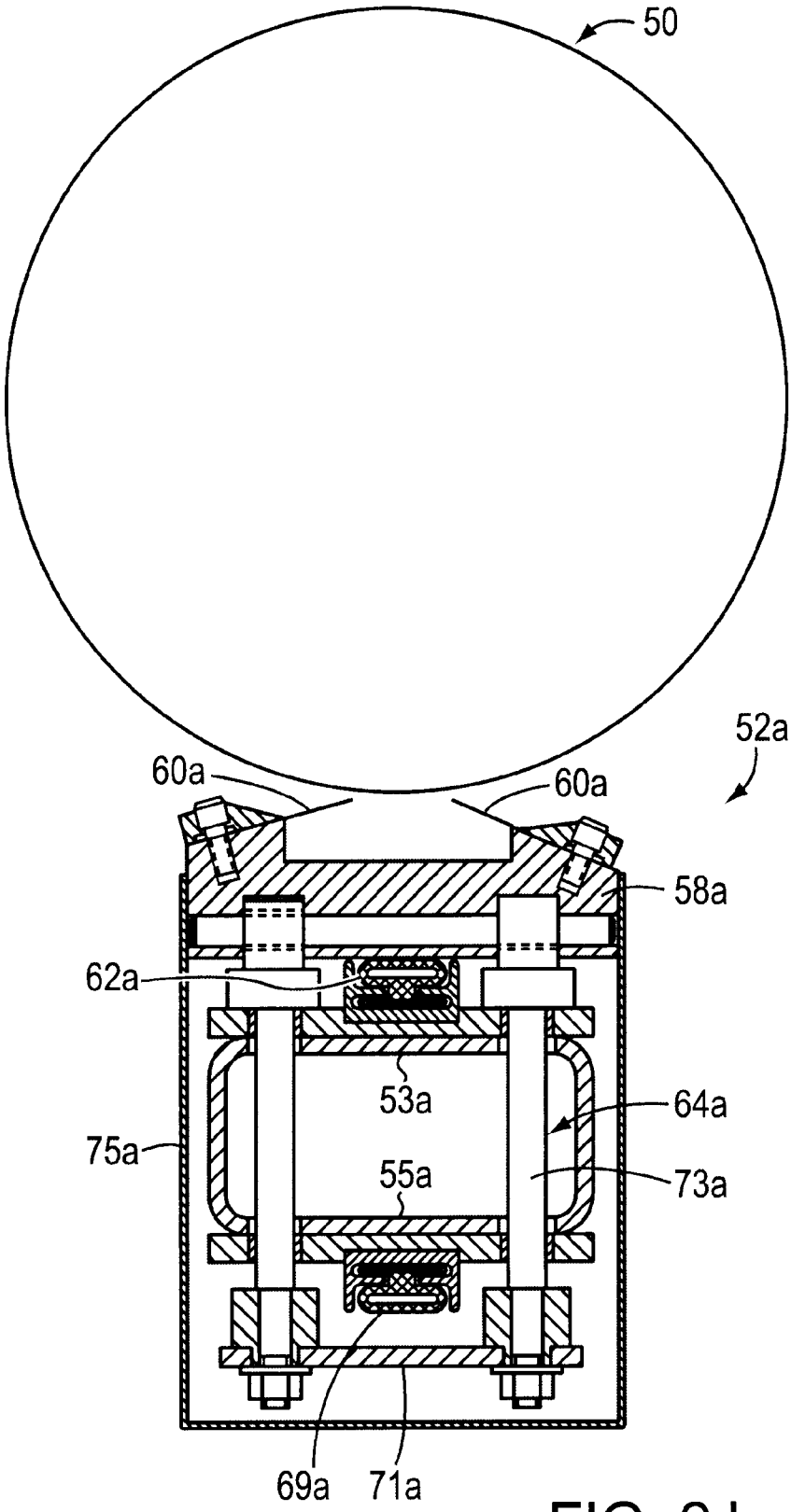
FIG. 2J is a cross sectional view of the ink applicator of FIG. 2H, showing the ink chamber mechanism in an engaged position.
Figure 2K:
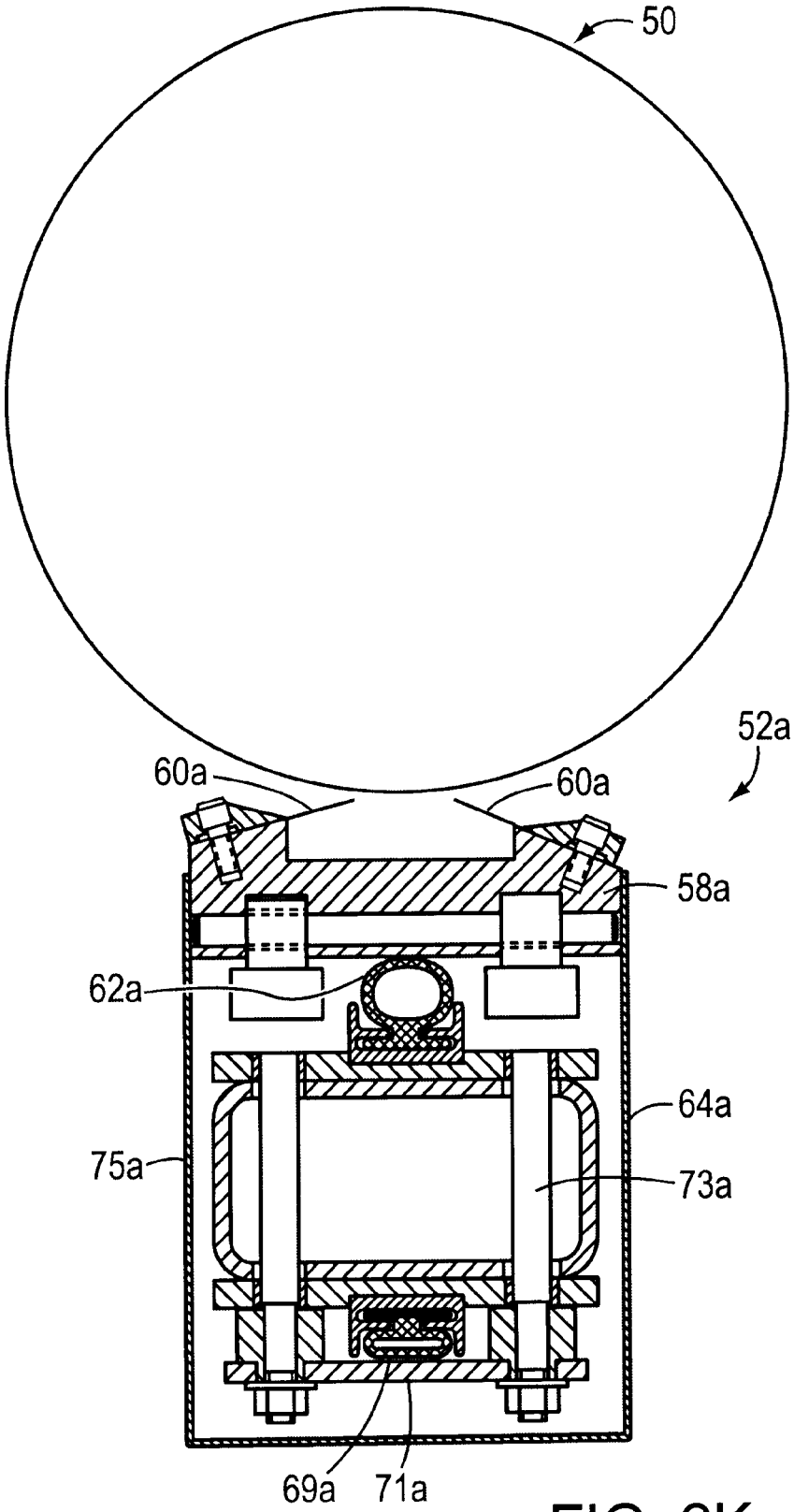
FIG. 2K is a cross sectional view of the ink applicator of FIG. 2H, showing the ink chamber mechanism in an engaged position with worn blades.

FIG. 2H shows the alternative ink chamber mechanism 52*a* fitted with new blades 60*a* and in a retracted position. FIG. 2J shows the ink chamber mechanism 52*a* fitted with new blades 60*a* and in an engaged position. FIG. 2K shows the engaged ink chamber mechanism 52*a* after the blades 60*a* have worn down from use. As can be seen in the drawings figures, the first tube 62*a* can be selectively inflated and the second tube 69*a* deflated to bias the ink well 58*a* into an engaged position relative to the engraved roll 50, and the first tube 62*a* can be selectively deflated and the second tube 69*a* inflated to bias the ink well 58*a* into a retracted position. The linear guide mechanism provides for linearly moving the ink chamber mechanism 52*a* between the engaged and retracted positions and in an axial direction relative to the corresponding engraved roll 50. This provides the advantage of the angle of the blades 60*a* relative to the engraved roll 50 remaining constant as the blades 60*a* wear, for uniform printing over the life of the blades 60*a*.

Figure 3:
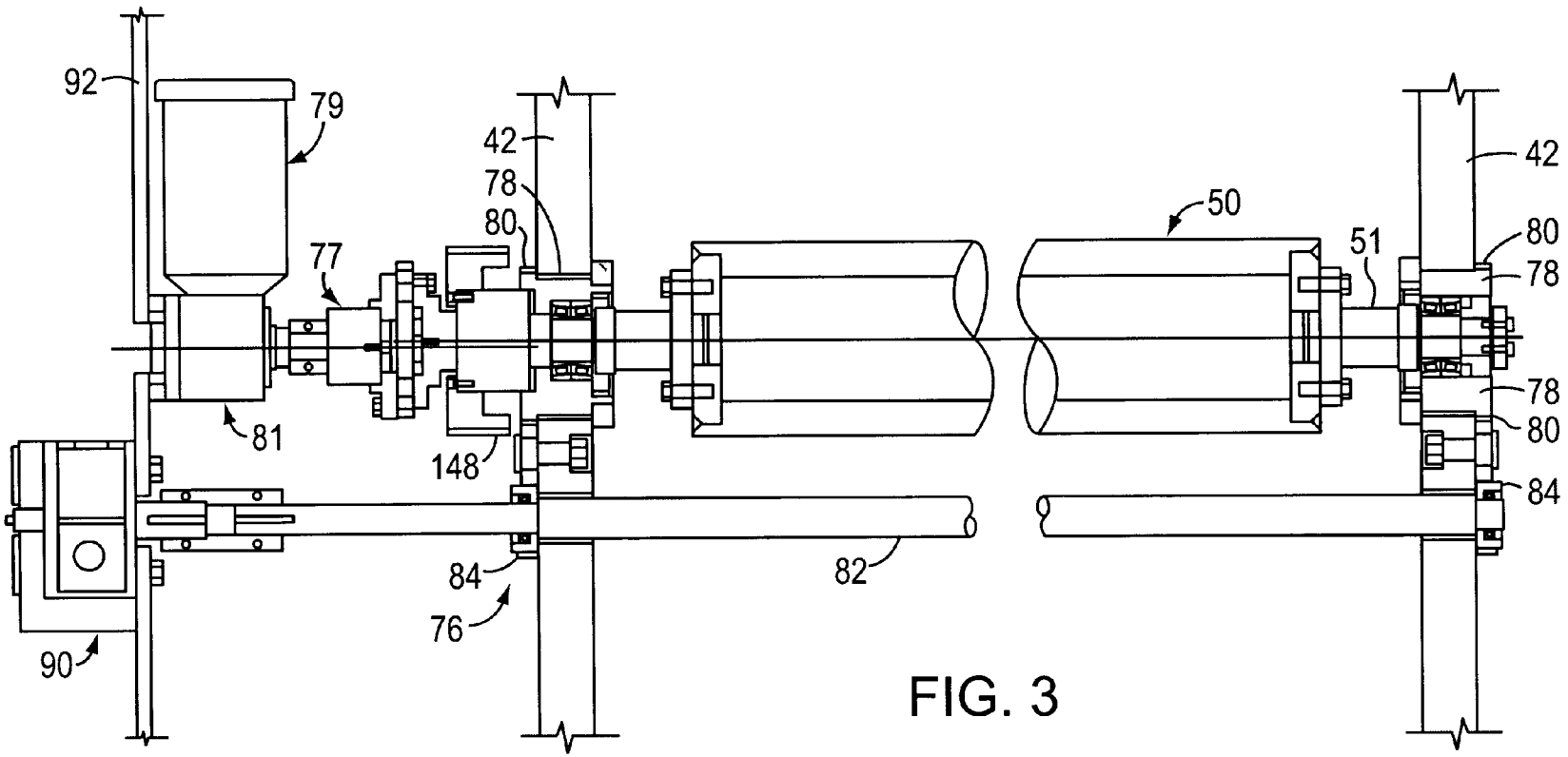
FIG. 3 is a cross sectional view through the print section taken along line 3—3 of FIG. 1A, showing an engraved roll of one of the ink applicators, an applicator adjustment mechanism, a primary actuator for movably positioning the ink applicators, and an idle drive mechanism for independently rotating the engraved roll.

Referring now to FIG. 3, an applicator adjustment mechanism 76 is provided for moving each ink applicator 46 between the engaged and retracted positions. Thus, a print section 36 with two ink applicators 46 can also have two applicator adjustment mechanisms 76, so that each ink applicator 46 can be engaged or retracted independent of each other ink applicator 46. The exemplary applicator adjustment mechanism described herein includes eccentric bearings as described below, but other adjustment mechanisms for moving the ink applicators between the engaged and retracted positions can be suitably employed, such as those having a rack and pinion gear-set, piston-cylinder mechanism, cam arrangement, and so forth.

Each applicator adjustment mechanism 76 has two eccentric bearings 78, with one of the eccentric bearings 78 rotationally mounted by, for example, a rotary bearing on one end of the engraved roll axle 51 and the other eccentric bearing 78 rotationally mounted by, for example, a rotary bearing on the other of the engraved roll axle 51. Also, one of the eccentric bearings 78 is rotationally mounted by, for example, a rotary bearing to the left side of the print section frame 42 and the other eccentric bearing 78 is rotationally mounted by, for example, a rotary bearing to the right side of the print section frame 42.

The eccentric bearings 78 are generally disc-shaped and mounted onto the engraved roll axle 51 at an off-center position of the eccentric bearings 78. Alternatively, the eccentric bearings 78 can have another regular or irregular shape. Because the engraved roll axle 51 is off-center and rotationally mounted relative to the eccentric bearings 78, rotating the eccentric bearings 78 causes the corresponding engraved roll 26 to move in a radial direction relative to the print roll 26, that is, closer to or farther away from the print roll 26.

Additionally, when the machine is stopped for rest breaks, lunch, maintenance, jams, etc., it is desirable to keep the inked engraved rolls rotating to prevent the ink on them from drying. Therefore, an idle drive mechanism can be provided for rotating the engraved rolls independent of the drive (described below) for the corresponding ink applicator. The idle drive mechanism can include a clutch 77 such as a FORMSPRAG™ overriding clutch Model 500 connected to one of the eccentric bearings 78, the engraved roll axle 51, or another component of the machine. A motor 79 such as an electric motor, and a gear-set 81 such as a MORSE RAIDER™ worm reducer Model 206QH56 Style QHVL can be connected to the clutch 77 for independently rotating the engraved roll 50. Another clutch 77, motor 79, gear-set 81, and/or control or other component of types known in the art can be provided, as may be desired.

In order to rotate the eccentric bearings 78, each applicator adjustment mechanism 76 has an eccentric bearing gear 80 formed on or mounted to each of the eccentric bearings 78, an adjusting shaft 82 rotationally mounted to the frame by, for example, a rotary bearing, and an adjusting shaft gear 84 mounted to or formed on the adjusting shaft 82 and driving the eccentric bearing gear 80. The adjusting shaft gear 84 can mesh with and drive the eccentric bearing gear 80 directly, or one or more intermediate gears can be provided to accomplish the desired gear ratio, rotational direction, and/or axial separation. The adjusting shaft 82 can be rotated by a ratchet, wheel, crank, motor, or other mechanism for generating a rotary motion to move the corresponding ink applicator 46.

Figure 3A:
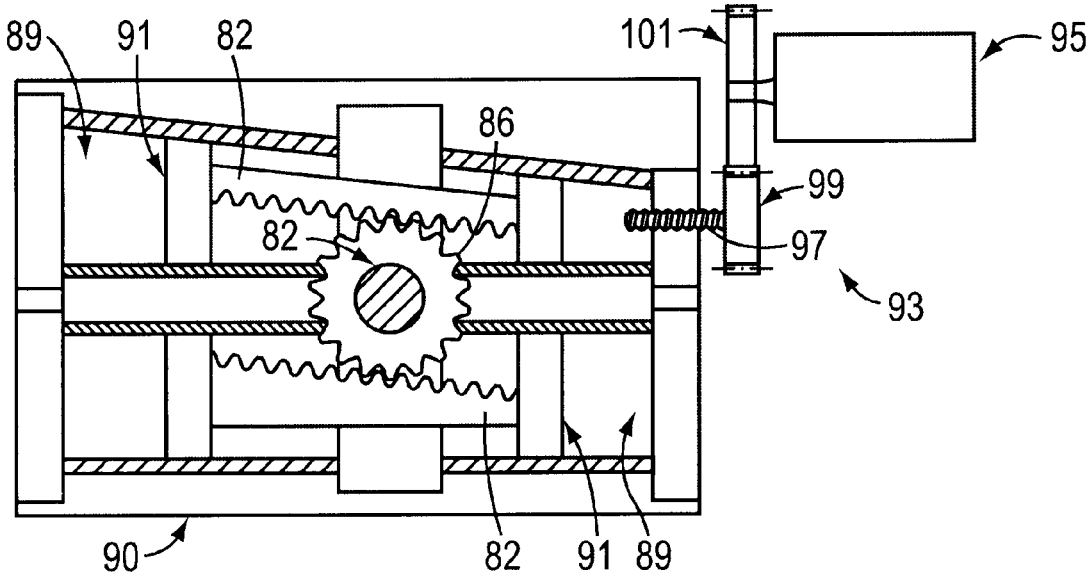
FIG. 3A is a detail view of the actuator of FIG. 3, and showing a secondary actuator and travel limiting mechanism connected thereto.

Referring further to FIG. 3A, in order to provide for quick and easy adjustment of the ink applicators 46 between the engaged and retracted positions, a primary actuator 90 can be provided for rotating the adjustment shaft 82. The actuator 90 is coupled to the adjusting shaft 82 and mounted to the print section frame 42, a guard panel 92, or another component of the machine 10. The actuator 90 can be a rotary actuator 90 with a pinion gear 86 that mounts onto the adjusting shaft 82, one or more rack gears 88 meshing with the pinion gear 86, and one or more air or other fluid cylinders 89 (or other linear travel mechanism) each with a piston 91 that is slidable within the cylinder and that engages one of the rack gears 88.

A suitable rotary actuator is Model 8000 sold by PHD™, Inc. of Fort Wayne, Ind. Alternatively, another type of rotary or linear actuator can be suitably employed, such as an electric motor that is coupled directly to the adjusting shaft 82, a solenoid, piston-cylinder, or other linear travel mechanism driving a worm gear-set or a spring-loaded lever or pull rod, or anther actuator for rotationally driving the adjusting shaft 82. In some applications, it may be desirable to provide the rack gear 88 and the pinion gear 86 separate from the actuator 90 and mounted to or formed on the adjusting shaft 82. Thus, by actuating one of the actuators 90, the machine operator can move the corresponding ink applicator 46 between the engaged and retracted positions.

In order to provide for quickly and easily adjusting the ink applicators 46 into very precise engaged (and retracted) positions, a travel limiting mechanism 93 can be provided for precisely controlling the operation of the primary actuator 90. Also, a secondary actuator 95 can be operatively coupled to the travel limiting mechanism 93 for precisely controlling the travel limiting mechanism.

Where the primary actuator 90 includes a piston-cylinder or other linear travel mechanism, the travel limiting mechanism 93 limits the linear travel of the rack gear 88, and thus limits the rotation of the adjusting shaft 82 and the controls the exact position of the ink applicator 46. In this case, the travel limiting mechanism 93 can be provided by an axial member 97 with an end that that extends into the actuator 90, abuts the piston 91, the rack gear 88, or another component of the actuator (when the piston is at the end of its reciprocating travel), and can be linearly extended or retracted to adjust the limit of the travel. Thus, the axial member 97 can be provided by a threaded screw or bolt that mates with a corresponding threaded portion of the actuator 90, and a first pinion gear 99 can be mounted to or formed onto the screw or bolt. Alternatively, the axial member 97 can be provided by a rack gear, worm gear, pin, cam, or the like.

The travel limiting mechanism 93 can further include a second pinion gear 101 connected to and driven by the secondary actuator 95, and meshing with the first pinion gear 99. The first and second pinion gears 99 and 101 can be selected to be sufficiently wide so that when the first pinion gear 99 is axially extended and retracted into and out of the actuator 90, the first and second pinion gears remain meshed and operatively engaged.

The secondary actuator 95 can be mounted to the machine frame 42, the machine guard panel 92, or another component of the machine 10. The secondary actuator 95 can be provided by an incremental actuator such as a commercially available stepper motor that can be operated in discrete, uniform increments, to very precisely control the position of the ink applicator. Thus, the secondary actuator 95 is selected for imparting a precise and controllable motion to the travel limiting mechanism 93. An example of a suitable stepper motor is that made by Arrick Robotics™ of Hurst, Tex. Of course, other travel limiting mechanisms 93 and secondary actuators 95 can be selected as desired for limiting the travel of other types of rotary or linear actuators 90.

Figure 3B:
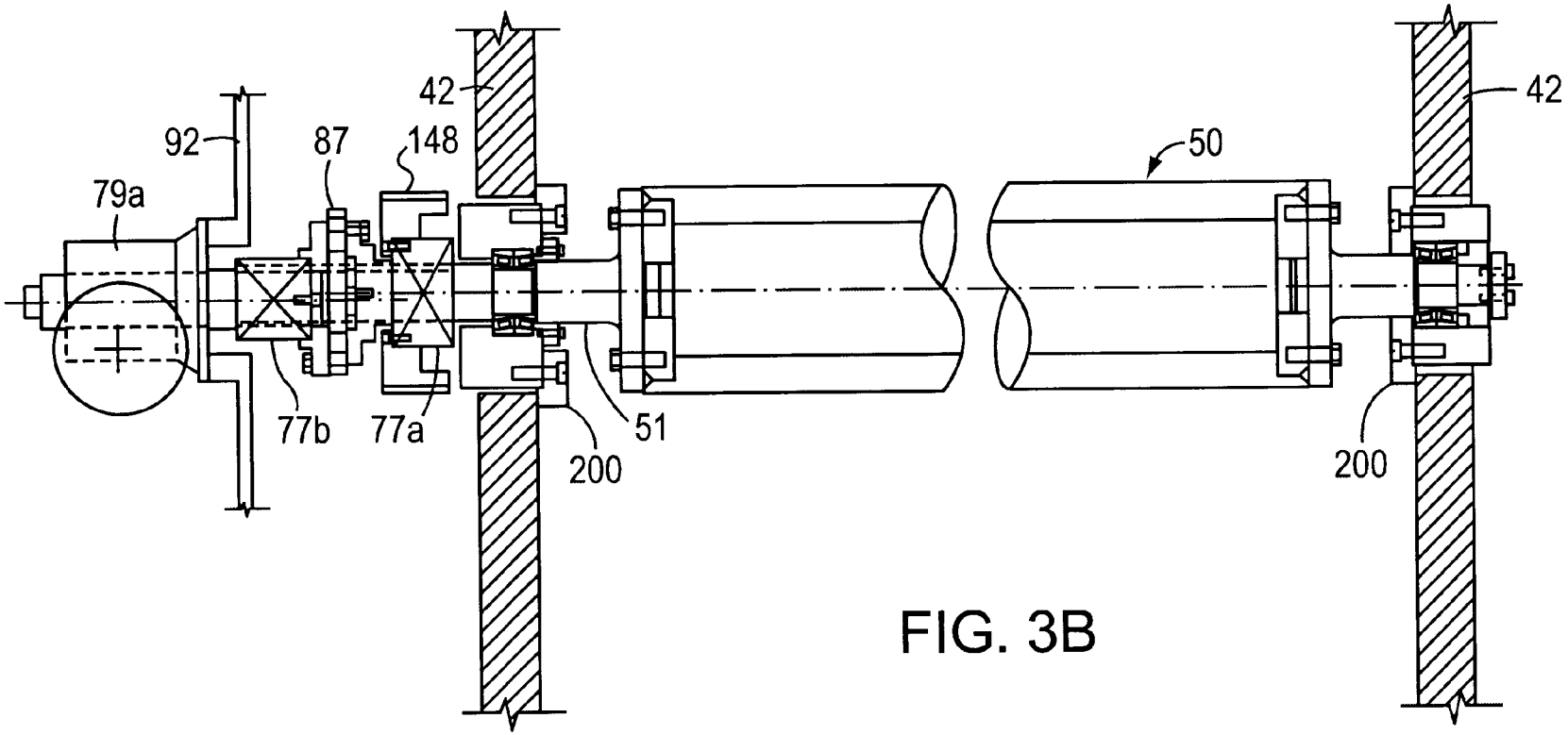
FIG. 3B a cross sectional view through the print section taken along line 3—3, showing an alternative idle drive mechanism.

Referring to FIG. 3B, there is illustrated an alternative idle drive mechanism for rotating the engraved rolls 50 independent of the drive (described below) for the corresponding ink applicator 46. Similar to the above-described idle drive mechanism, there is provided a first overriding clutch 77*a* directly connected to the engraved roll axle 51, or indirectly connected thereto via another component of the machine. A second overriding clutch 77*b* is connected to the first clutch 77*a* via a coupling 87 such as an Oldham™ coupling. A motor 79*a* such as an electric motor is connected to the second clutch 77*b*, for independently rotating the corresponding engraved roll 50. Another number or type clutches 77*a* and 77*b* and/or coupling 87 can be provided, as may be desired. FIG. 3B also shows pivot arms 200 of an alternative applicator adjustment mechanism 76*a* described immediately below.

Figure 3D:
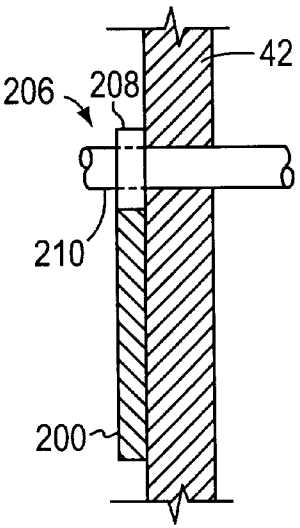
FIG. 3D is a cross sectional detail view of a portion of the alternative applicator adjustment mechanism of FIG. 3C taken along line 3D—3D, showing a cam stop arrangement.
Figure 3C:
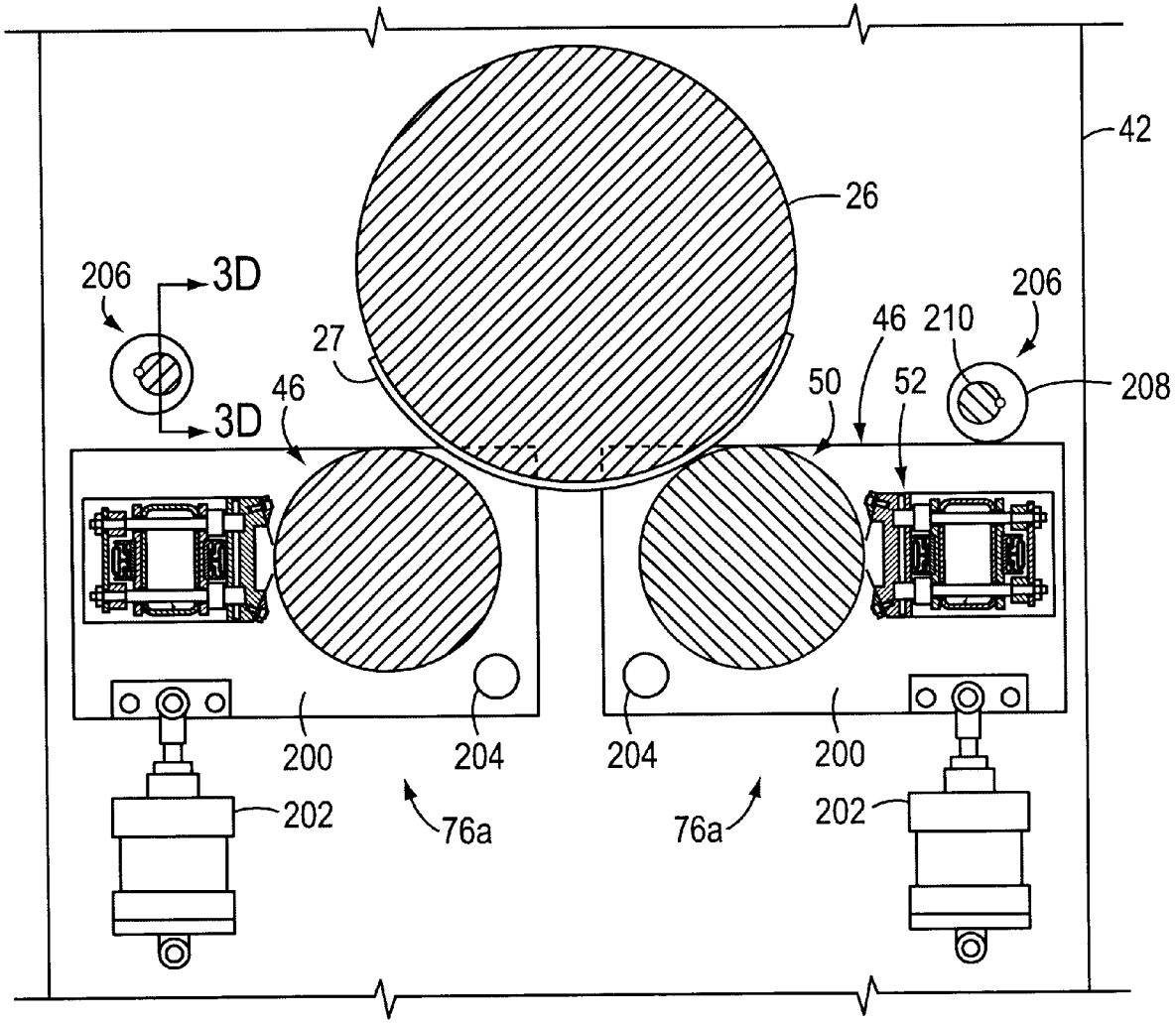
FIG. 3C is a detail view of an alternative applicator adjustment mechanism, showing a dual pivot arm arrangement.
Figure 3F:
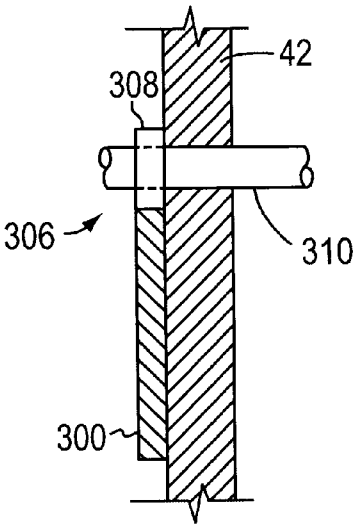
FIG. 3F is a cross sectional detail view of a portion of the alternative applicator adjustment mechanism of FIG. 3E taken along line 3F—3F, showing a cam stop arrangement
Figure 3E:
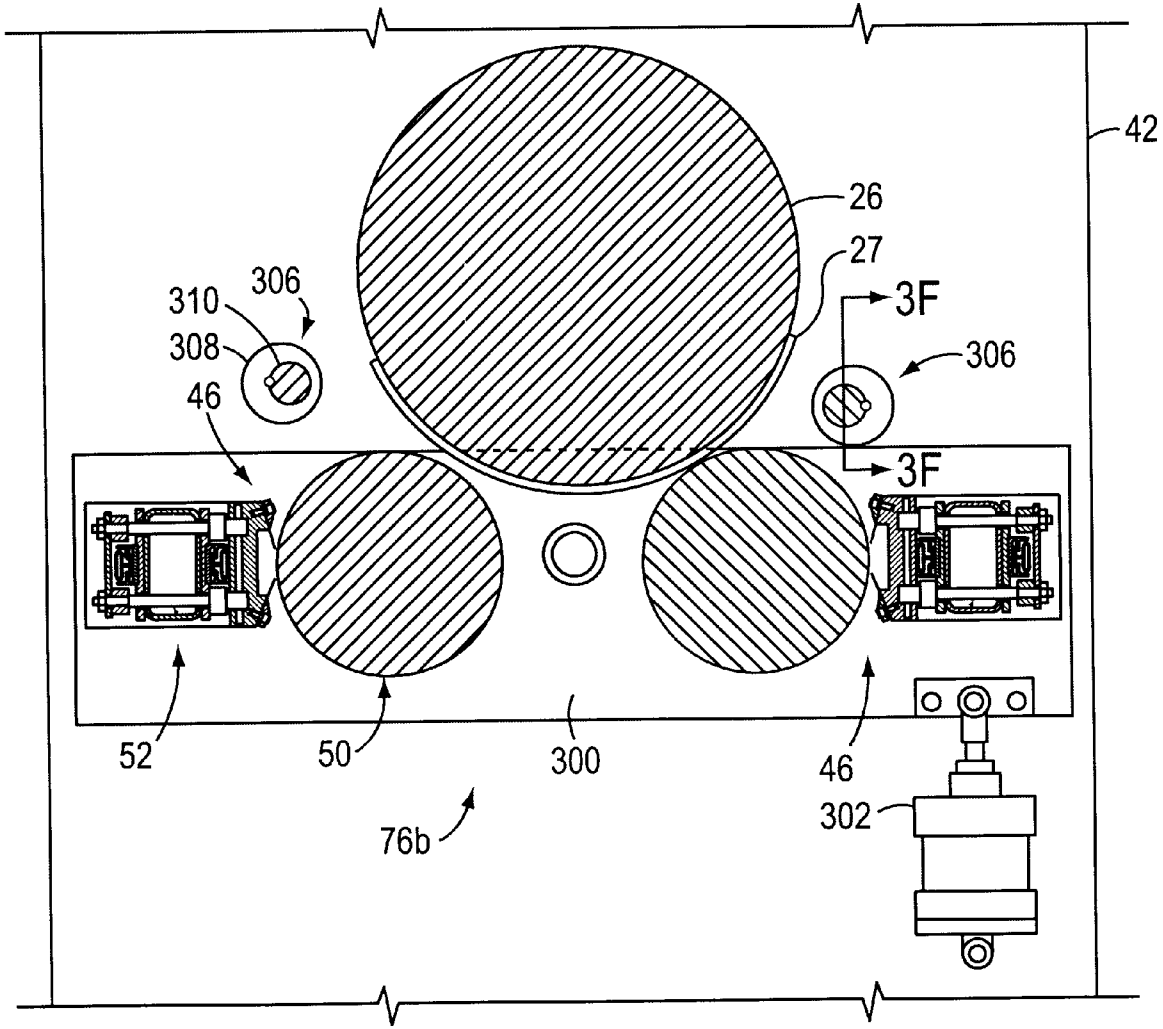
FIG. 3E is a detail view of another alternative applicator adjustment mechanism, showing a single pivot arm arrangement.

Referring to FIGS. 3D and 3E, there is illustrated alternative applicator adjustment mechanism 76*a*, which comprises pivot arm 200 and an actuator 202. One applicator adjustment mechanism 76*a* is provided for each ink applicator 46, with the ink applicator 46 mounted to the pivot arm 200 and the actuator 202 operatively coupled to the pivot arm 200. Each pivot arm 200 is pivotally coupled to the frame 42 or another component of the machine at pivot point 204. The actuators 202 are provided by conventional air cylinders, though hydraulic cylinders, other fluid cylinders, worm gear actuators, electric motors, or other actuators known in the art can be suitably employed. Alternatively, a rotational actuator can be positioned to engage the end of the pivot arm for pivoting the arm, by including gears if desired.

Upon operation of one of the actuators 202, the corresponding pivot arm 200 is pivoted so that the corresponding ink applicator 46 is pivoted about the pivot point 204 and between the engaged position and the retracted position. The pivotal range of motion of the pivot arms 200 can be limited by stops 206. Additionally, the stops 206 can be provided by eccentric cams 208 mounted on shafts 210, which can be rotated to adjust the limit of the pivotal motion of the corresponding pivot arm 200.

Referring to FIGS. 3F and 3G, there is illustrated another alternative applicator adjustment mechanism 76*b* comprising a pivot arm 300 and an actuator 302 (similar to actuator 202). One applicator adjustment mechanism 76*a* is provided for two or more ink applicators 46 (and thus for each print roll 26), with the ink applicators 46 mounted to the pivot arm 300 and the actuator 302 operatively coupled to the pivot arm 300. The pivot arm 300 is pivotally coupled to the frame 42 or another component of the machine at pivot point 304, with the pivot point 304 positioned between the ink applicators 46. Upon operation of the actuator 302, the pivot arm 300 and ink applicators 46 are pivoted between the engaged position and the retracted position. The pivotal range of motion of the pivot arm 300 can be limited and adjusted by stops 306 having eccentric cams 308 mounted on shafts 310, similar to the arrangement described above.

It will be understood that the applicator adjustment mechanism can be provided with more than two pivot arms, each with at least one ink applicator, for each print roll. Additionally, three or more ink applicators can be provided on a single pivot arm. Furthermore, where multiple ink applicators are provided on each pivot arm, each ink applicator can be adjustable by an eccentric gear mechanism operatively coupled to the pivot arm, similar to the eccentric gear mechanism described above. Moreover, other configurations and combinations of pivot arms and eccentric gear mechanisms can be suitably employed.

Figure 4:
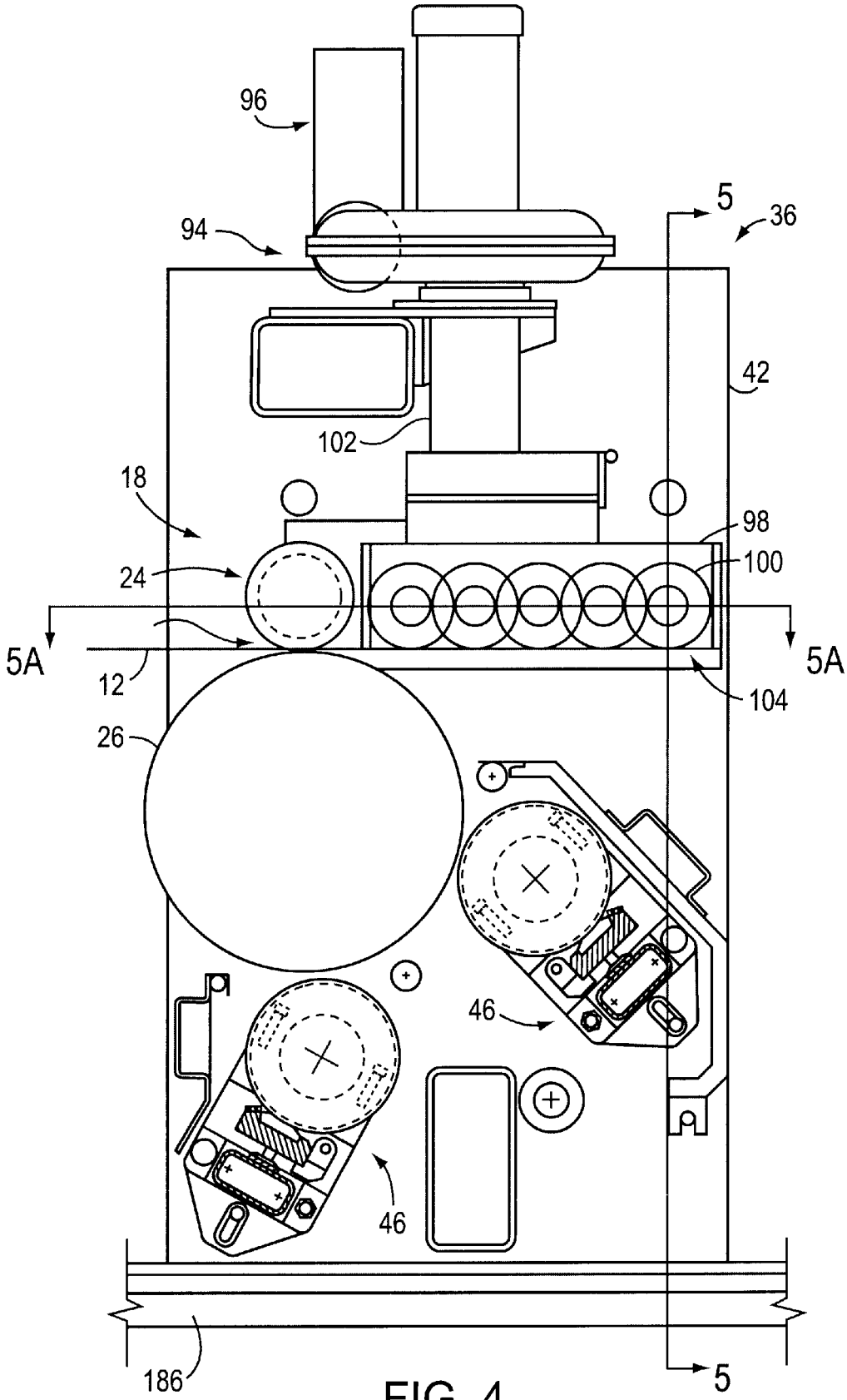
FIG. 4 is a side view of one of the print sections, showing the ink applicators and the transfer mechanism.
Figure 5:
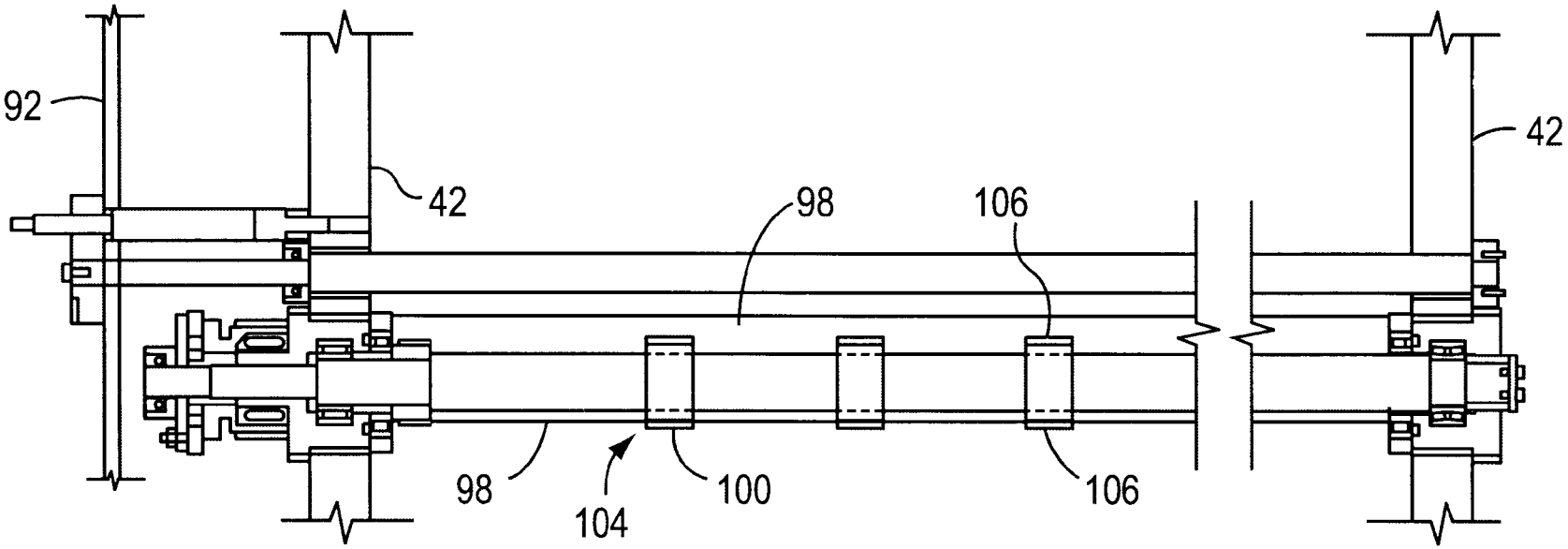
FIG. 5 is a cross sectional side view of the transfer mechanism taken through the print section along line 5—5 of FIG. 4.
Figure 5A:
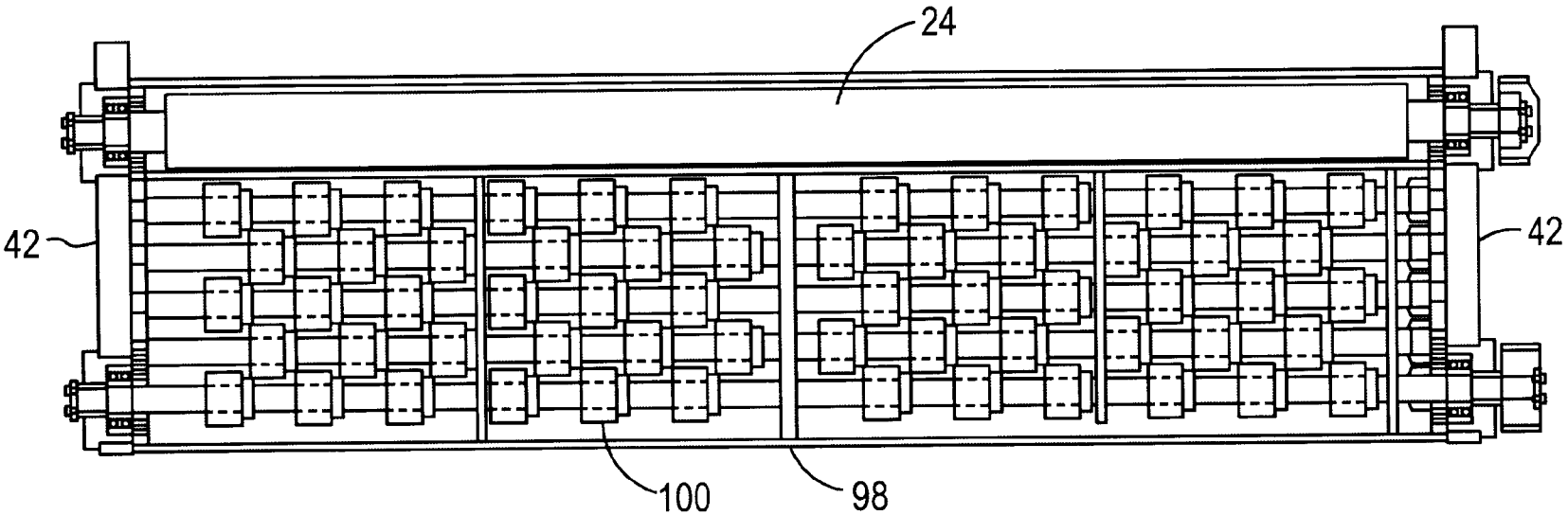
FIG. 5A is a cross sectional plan view of the transfer mechanism taken through the print section along line 5A—5A of FIG. 4.

Referring to FIGS. 4, 5, and 5A, the blanks 12 are drawn through the nip 28 of the print mechanism 18 by a transfer mechanism such as a vacuum transfer mechanism 94. The vacuum transfer mechanism 94 has a suction mechanism 96, a vacuum housing 98, and one or a plurality of transfer rollers 100. The suction mechanism 96 can be provided by a commercially available device for creating a vacuum. The vacuum housing 98 is connected to the suction mechanism 96 by a conduit 102, which can be linear, curved, or have another shape. Also, the vacuum housing 98 has openings 104 defined therein for air intake, and the transfer rollers 100 extend through the openings 104. The transfer rollers 100 can have covers made of urethane or another generally soft, pliable material that provides a high coefficient of friction.

Air is suctioned through the portion of the openings 104 not blocked by the rollers 100 and into the housing 98, thereby drawing the blanks 12 up and into contact with the rollers 100. Thus, the transfer rollers 100 contact and impart motion to the blanks 12 on their top sides instead of on their freshly printed bottom sides to avoid smudging the printing. The blanks 12 are thereby pulled through the print section 36 and transported on to another section for further operation as may be desired. Similar vacuum transfer mechanisms are known in the art, and other transfer mechanisms known in the art can be suitably employed.

Figure 6:
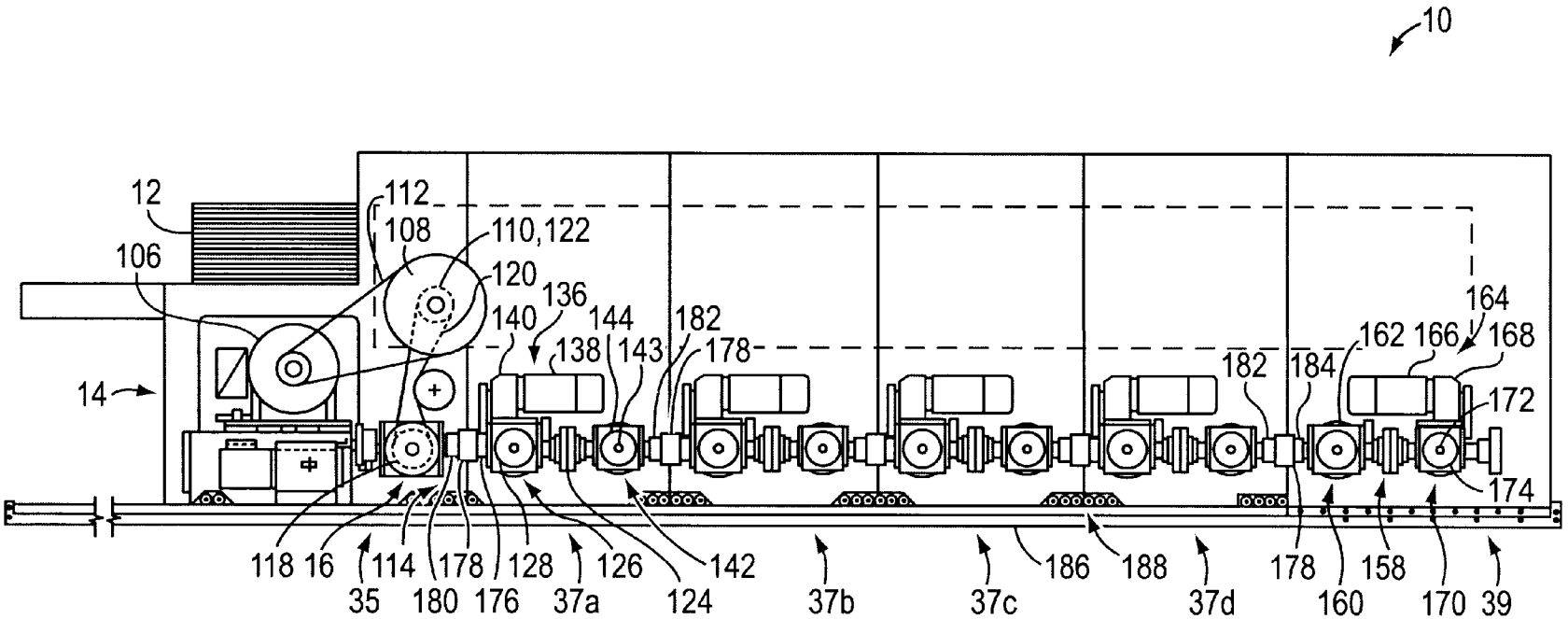
FIG. 6 is a right side view of the machine showing the transmission shaft of the rotary drive mechanism.

Referring now to FIG. 6, the machine has a main drive mechanism that rotationally drives the feed mechanism 16, the print mechanisms 18, and the cutter mechanism 20. The main drive mechanism includes a rotary power source such as an electric motor 106, the modular feed drive 35, the modular print drives 37, and the modular cutter drive 39. Alternatively, the main drive can have only one or two belts or gear trains that interconnect and rotationally drive the feed mechanism 16, the print mechanisms 18, and the cutter mechanism 20 all together. Thus, the term "main drive" as used herein includes drive systems having a plurality of sprockets interconnected and synchronously driven by a belt such as a toothed belt, chained belt, or chain, one or more gear trains with a plurality of meshing gears, and other mechanical and electrical drive trains known in the art.

Figure 7:
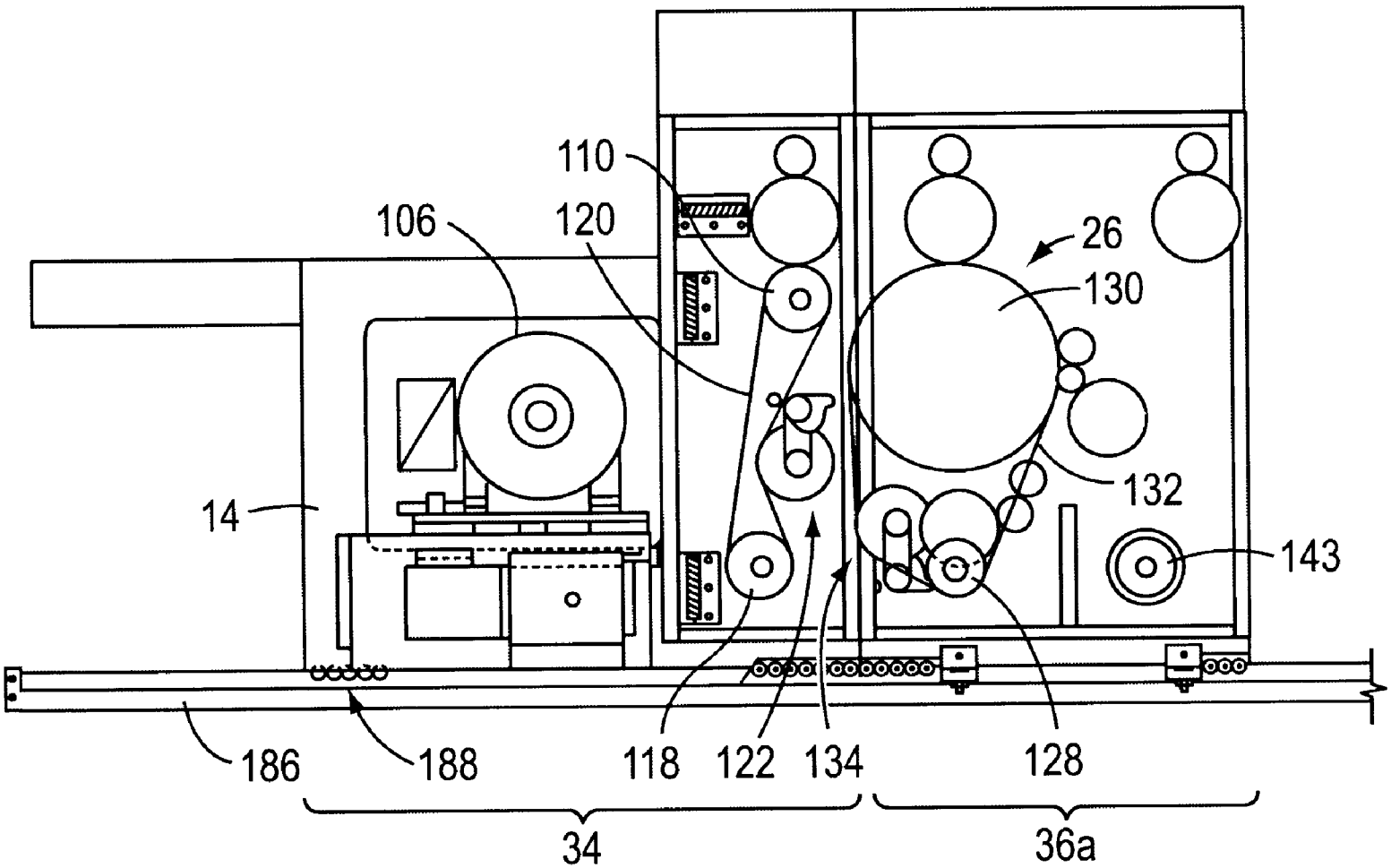
FIG. 7 is a right side view of the machine showing the belts and sprockets of the feed drive mechanism and the first print drive mechanism.

Referring to FIGS. 6 and 7, in this exemplary embodiment, the rotary feed drive 35 has a first feed roll sprocket 108 and a second feed roll sprocket 110 each mounted to or formed on one of the feed rolls 22, and a first feed belt 112 connecting the motor 106 to the first feed roll sprocket 108, for rotationally driving the feed roll 22. The rotary feed drive 35 also has a rotary feed transmission shaft 114, a direction changing gear-set 116 connected to the feed transmission shaft 114, a feed drive sprocket 118 connected to the right angle gear-set 116, and a second feed belt 120 connecting the second feed roll sprocket 110 to the feed drive sprocket 118, for rotationally driving the transmission shaft 114. A suitable right angle gear-set is the ANDANTEX™ Model ZR20 precision spiral bevel gearbox. "Direction changing gear-set" as used herein includes right angle gear-sets as well as other gearing arrangements for converting rotation in one axial direction to rotation in another axial direction. Additionally, conventional belt tensioning mechanisms with belt tensioning rolls 122 can be provided as desired.

The print drives 37 each have a rotary print transmission shaft 124 and a first print drive mechanism with a first direction-changing gear-set 126 connected to the print transmission shaft 124, a first print drive sprocket 128 connected to the right angle gear-set 126, a print roll sprocket 130 mounted to or formed on the print roll 26, and a first print belt 132 connecting the first print drive sprocket 128 to the print roll sprocket 130, for rotationally driving the print roll 26. Additionally, conventional belt tensioning mechanisms with belt tensioning rolls 134 can be provided as desired.

Figure 8:
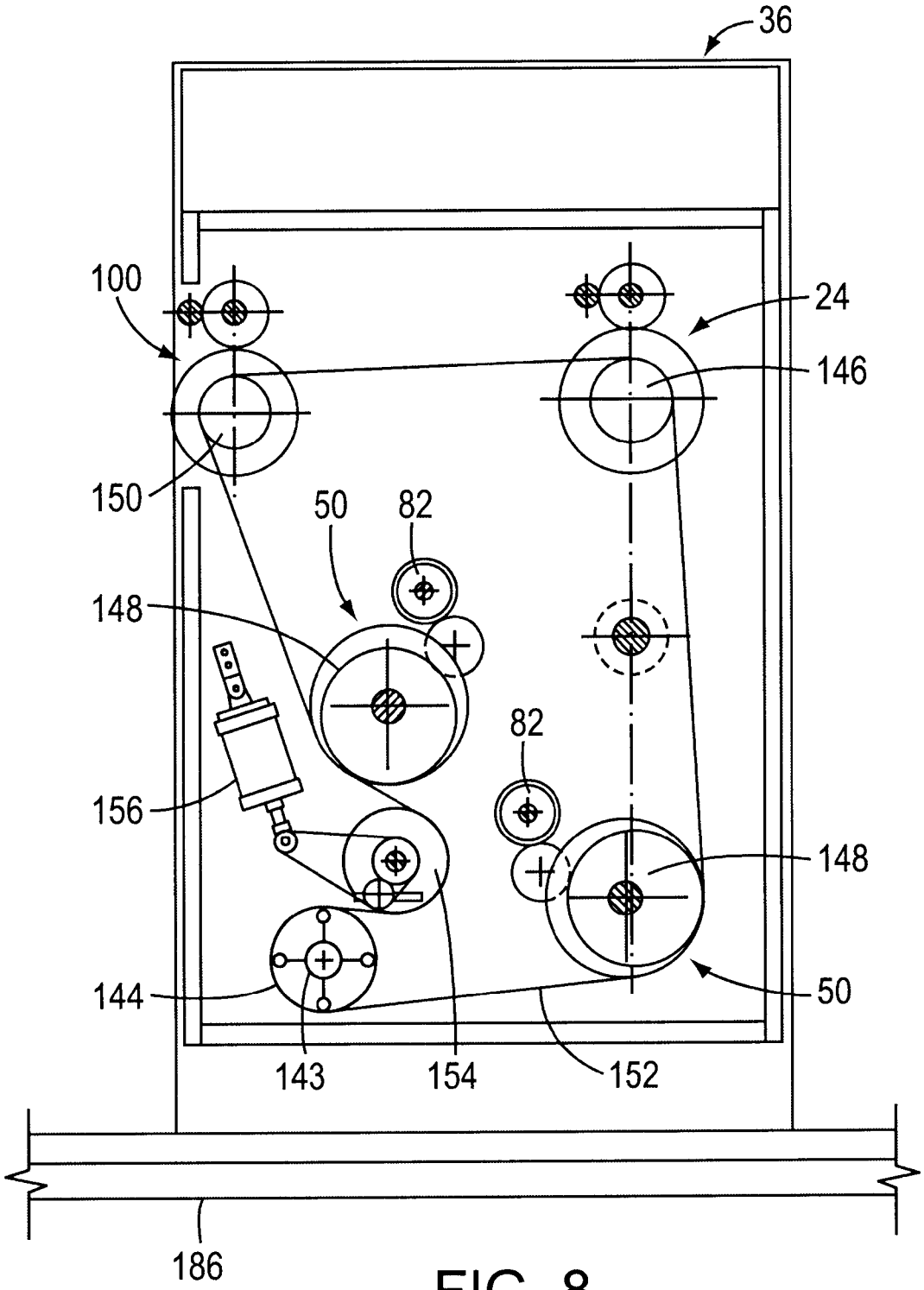
FIG. 8 is a left side view of the machine showing the belts and sprockets of the second rotary print drive mechanism.

Referring to FIGS. 6 and 8, each print drive 37 also has a second print drive mechanism with a second print direction-changing gear-set 142 connected to the print transmission shaft 124, a connector shaft 143 extending across a substantial portion of the width of the machine 10 and connected to the second right angle gear-set 142, a second print drive sprocket 144 connected to the connector shaft 143, an impression roll sprocket 146 mounted to or formed on the impression roll 24, an engraved roll sprocket 148 mounted to or formed on each of the engraved rolls 50, a transfer roll sprocket 150 mounted to or formed on at least one of the transfer rollers 100, and a second print belt 152 connecting the second print drive sprocket 144 to and rotationally driving the impression roll sprocket 146, the engraved roll sprockets 148, and the transfer roll sprocket 150. Additionally, conventional belt tensioning rolls 154 and belt tensioning mechanisms 156 can be provided as desired.

Thus, the first print drive mechanism (with the first print drive sprocket 128 driving the print roll 26) and the second print drive mechanism (with the second print drive sprocket 144 driving the impression roll sprocket 146, the engraved roll sprockets 148, and the transfer roll sprocket 150) are disposed on opposite sides of the machine 10. Alternatively, the first and second print drive sprockets 128 and 144 can be arranged on the same side of the machine 10, in a generally vertical or staggered configuration, or in other arrangements.

Referring back to FIG. 6, the cutter drive 39 has a first cutter drive mechanism that is similar to the first print drive mechanism, and a rotary cutter transmission shaft 158. Thus, the first cutter drive mechanism has a first direction-changing gear-set such as a right angle gear-set 160 connected to the cutter transmission shaft 158, a first cutter drive sprocket 162 connected to the right angle gear-set 160, a cutter roll sprocket (not shown) mounted to or formed on the cutter roll 32, and a first cutter belt (not shown) connecting the first cutter drive sprocket 162 to the cutter roll sprocket (not shown), for rotationally driving the cutter roll 32. Additionally, conventional belt tensioning mechanisms with belt tensioning rolls (not shown) can be provided as desired. Such cutter drives 39 are known in the art.

The cutter drive 39 also has a second cutter drive mechanism that is similar to the second print drive mechanism. The second cutter drive mechanism has a second direction-changing gear-set such as a right angle gear-set 170 connected to the cutter transmission shaft 158, a connector shaft 172 extending across a substantial portion of the width of the machine 10 and connected to the second right angle gear-set 170, a second cutter drive sprocket 174 connected to the connector shaft 172, an anvil roll sprocket (not shown) mounted to or formed on the anvil roll 30, and a second cutter belt (not shown) connecting the first cutter drive sprocket 162 to the anvil roll sprocket (not shown), for rotationally driving the anvil roll 30. Additionally, conventional belt tensioning mechanisms with belt tensioning rolls (not shown) can be provided as desired.

Figure 9:
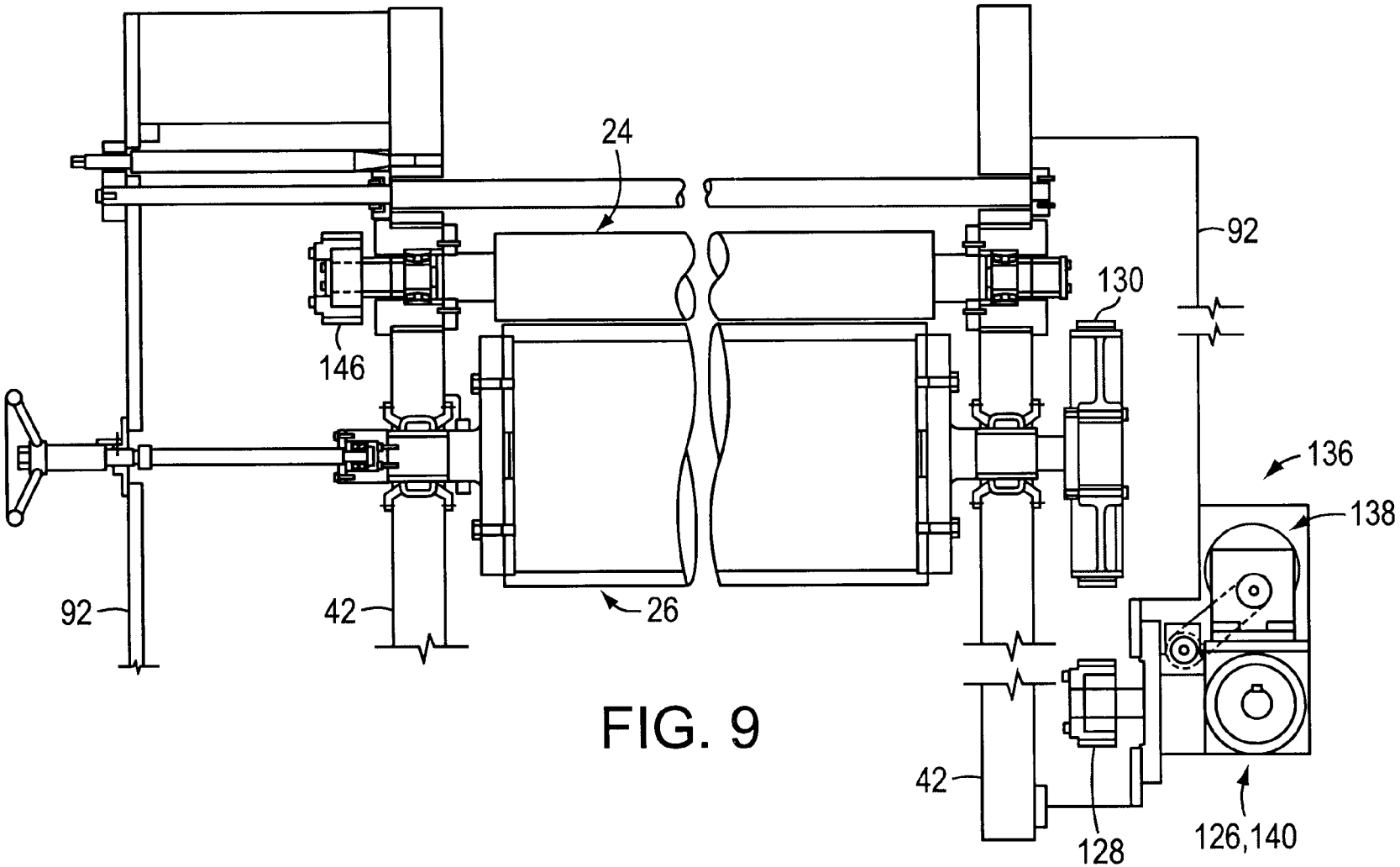
FIG. 9 is a cross sectional view taken through the print mechanism showing the print registration mechanism.

Referring now to FIG. 9, in order to quickly and easily adjust the registration of the print roll 26, the machine 10 is provided with a print registration adjustment mechanism 136 having a gearmotor 138 that is connected to and drives a differential gear-set 140, which can be integrally provided with or connected to the printer first right angle gear-set 126 (see also FIG. 6). The gearmotor 138 can be provided by a conventional rotary electric motor or the like, such as BROWNING™ helical gearmotor Model 56-2101. The gearmotor 138 can be provided with two speeds, with a fast speed for use when mounting the print plate and a slow speed for use when making precise print roll registration adjustments. Where the differential gear-set 140 and the printer first right angle gear-set 126 are provided as one unit, a suitable unit is the ANDANTEX™ Model DR7-213. The differential gear-set 140 is selected so that operation of the gearmotor 138 allows the print roll 26 to rotate at a faster or slower rate than it is being driven by the print transmission shaft 124. Thus, the print roll registration can be adjusted by actuating the gearmotor 138 for a period of time until the timing mark of the print roll 26 aligns or coincides with the leading edge of the blanks 12 entering the nip 28, and then turning off the gearmotor 138. Alternatively or additionally, a stepper motor or other incremental actuator can be connected to and drive a control shaft of the differential gear-set, with the actuator controlled by a programmed computer, for precise adjustment of the print registration. Of course, another print registration adjustment mechanism having another gearmotor, differential gear-set, and/or brake motor as are known in the art can be suitably employed.

Referring back to FIG. 6, in order to quickly and easily adjust the registration of the cutter roll 32, the machine 10 can be provided with a cutter registration adjustment mechanism 164 similar to the print registration adjustment mechanism 136. Accordingly, the cutter registration adjustment mechanism 164 can have a gearmotor 166 connected to and driving a differential gear-set 168 that is provided separately from and connected to or provided integrally with the cutter second right angle gear-set 170. The structures provided by the print and cutter registration adjustment mechanisms 136 and 164 can also be employed to adjust the registration of the feed rolls and/or other rotary rolls for performing other operations on the blanks.

As discussed above, the print sections 36 are modular so that one or more of the print sections 36 can be retrofit onto certain existing printer-cutter machines and so that the print sections 36 can be quickly and easily separated for access to the ink applicators 46 for cleaning and maintenance. In order to provide this modularity feature, an input end 176 of the transmission shaft 124 of the modular print drive 37 is connected by a separable input coupling 178 to an output end 180 of the transmission shaft 114 of the modular feed drive 35 (for the first print section 36*a*) or to an output end of a preceding print section transmission shaft (for the second, third, or fourth print section 36*b*–36*d*). Similarly, an output end 182 of the transmission shaft 124 of the modular print drive 37 is connected by a separable input coupling 178 to an input end 184 of the transmission shaft 158 of the modular cutter drive 39 (for the last print section 36*d*) or to an input end of a subsequent print section transmission shaft (for the first, second, or third print section 36*a*–36*c*). The separable couplings 178 can be provided by a spline-type coupling, bolted plates, removable pins, a threaded engagement, mating eccentric flanges, a pawl and sprocket, gear couplings, toothed couplings, or another separable coupling permitting ready disconnection of the transmission shafts.

Furthermore, to facilitate quickly and easily moving apart the print sections 36 after they are decoupled for access to the ink applicators 46, the print sections are mounted on roller bearings 188 which are guided on a fixed linear track 186. The track 186 can be secured to a floor, platform, table, or other base by conventional fasteners. The roller bearings 188 are guided by the track 186 and support the feed section 34, each print section 36, and/or the cutter section 38. The roller bearings 188 can be provided by free-wheeling bottom rollers 188. Alternatively, the roller bearings 188 can be provided by a rotating thread, a lubricated junction, a motorized platform, a tilting table, a jack, a lifting or lowering mechanism, a swiveling table, or the like. The roller bearings 188 can be connected to the track 186, or to the feed section 34, print sections 36, or the cutter section 38.

Accordingly, the machine 10 can be employed in a method for retrofitting one or more of the modular print sections 36 onto a pre-existing machine, for example, a pre-existing machine having one or more print sections each with only one ink applicator. The method includes the steps of disassembling and removing a pre-existing print section, for example, by disconnecting separable couplings in the transmission shafts and rolling the modular sections apart. The new modular print section with two (or more) ink applicators is then positioned adjacent the feed section, cutter section, or other print section, as desired. The transmission shafts are aligned, the sections are rolled together, and the transmission shafts are coupled together. Additional connections for power, ink, and water supply can be made as desired. One, four, or any other number of modular print sections can be retrofit, depending on the number of pre-existing print sections and the available space. Because the print section is modular, old printer-cutter machines with single ink applicator print sections can be upgraded without the expense of purchasing and installing an entirely new machine.

Figure 10:
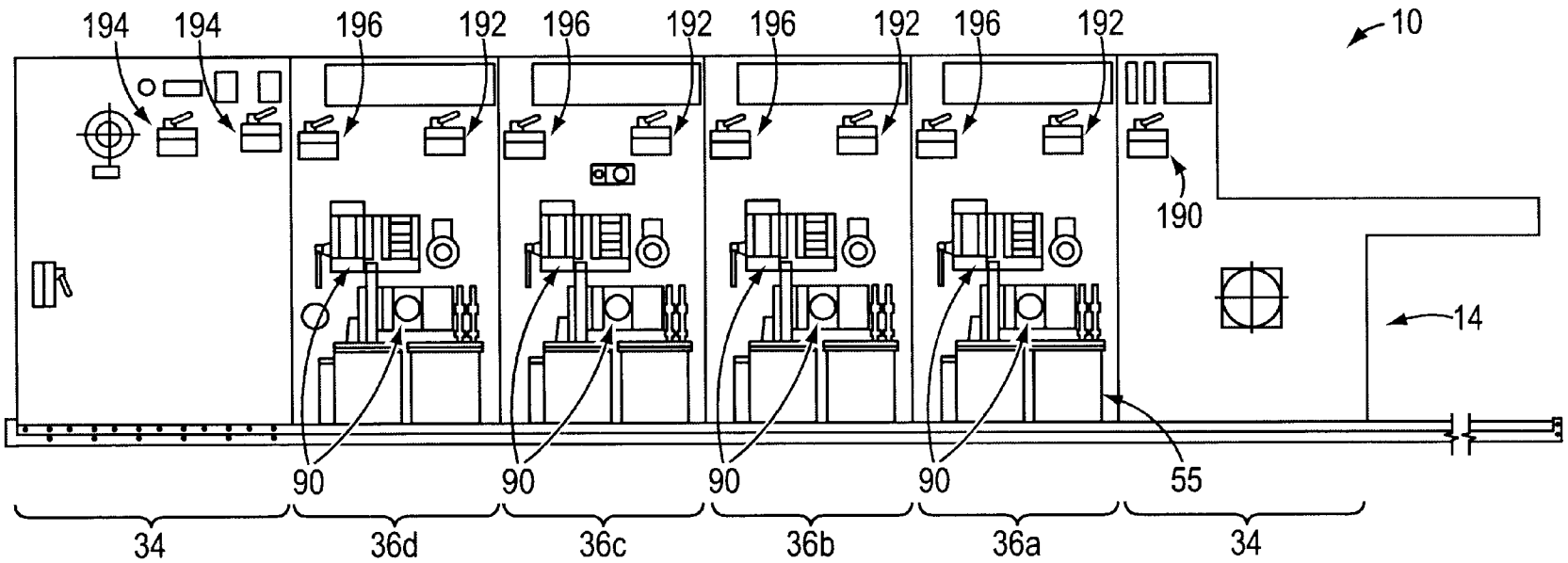
FIG. 10 is a left side view of the machine showing the operator controls.

Referring to FIG. 10, some or all of the controls for the machine 10 can be located on the left or operator side of the machine. The controls can include a feed mechanism nip adjustment control 190, a print mechanism nip adjustment control 192 for each print section 36, a cutter mechanism nip adjustment control 194 for each cutter section 38, a transfer mechanism adjustment control 196 for each print section 36 and cutter section 38, and the actuators 90 for adjusting the engraved rolls. Additional controls can be provided for the various motors, the transfer mechanism, and other components as is known in the art.

Referring to FIG. 11, the ink can be supplied to the ink wells 58 through the ink inlet line 57 which is connected to the ink reservoir 55 and the pump 61. The ink is cycled back to the ink reservoir 55 by the ink outlet line 57. Valving and metering (not shown) can be provided in the ink lines 57 and 59 for precise control of the ink volume supplied. Additionally, the water or other fluid line 63 connected to the ink lines and to the water or other fluid supply provides for cleaning the corresponding ink well and engraved roll. Alternatively, the ink wells and the engraved rolls can be cleaned manually or with other automatic cleaning mechanism as are known in the art.

Thus, it will be appreciated that the printer-cutter machine 10 provides a substantial improvement over the prior art by producing a significant reduction in downtime between printing-cutting jobs. This reduced downtime translates into a significant increase in the efficiency, productivity, and profitability of the machine 10.

In the embodiments described above and the following claims, the words "a," "an," and "one" are not intended to mean only "one" but can also mean any number greater than one, unless specified otherwise herein. Additionally, the sequence of the above-described method steps is provided for illustration purposes only; the steps can be performed in other sequences as may be desired.

While certain embodiments are described above with particularity, these should not be construed as limitations on the scope of the invention. It should be understood, therefore, that the foregoing relates only to the exemplary embodiment of the present invention, and that numerous changes may be made therein without departing from the spirit and scope of the invention as defined by the following claims.

The invention claimed is:

1. A machine for operating on blanks, comprising:

a machine frame;

at least one impression member supported by the frame;

at least one rotary print roll supported by the frame and disposed proximate to the impression member, wherein the impression member and the print roll define therebetween a nip for receiving the blanks in series and transporting the blanks through the machine;

at least two ink applicators for each print roll, each ink applicator comprising a rotary ink roll that rotates on an axle and an ink chamber mechanism disposed adjacent the ink roll, with each ink roll disposed proximate to the print roll and each ink applicator supported by the frame, wherein the ink chambers apply ink to the corresponding ink roll, which selectively apply ink to the print roll, which prints on the blanks;

at least two applicator adjustment mechanisms, wherein each applicator adjustment mechanism comprises two eccentric bearings, with one eccentric bearing rotationally mounted between an end of the axle and the frame and the other eccentric bearing rotationally mounted between another end of the axle and the frame, wherein at least one of the eccentric bearings has an eccentric bearing gear, and wherein each adjustment mechanism further comprises at least one adjusting shaft rotationally mounted to the frame and disposed proximate to one of the ink rolls, and at least one adjusting shaft gear coupled to the adjusting shaft and driving the eccentric bearing gear, wherein one applicator adjustment mechanism is operatively connected to one ink applicator and the other applicator adjustment mechanism is operatively connected to the other ink applicator, wherein each ink applicator is moved between an engaged position and a retracted position relative to the print roll in response to rotation of the adjusting shaft.

2. A machine for operating on blanks, comprising:

a machine frame;

at least one impression member supported by the frame;

at least one rotary print roll supported by the frame and disposed proximate to the impression member, wherein the impression member and the print roll define therebetween a nip for receiving the blanks in series and transporting the blanks through the machine;

at least two ink applicators for each print roll, each ink applicator comprising a rotary ink roll and an ink chamber mechanism disposed adjacent the ink roll, with each ink roll disposed proximate to the print roll and each ink applicator supported by the frame, wherein the ink chambers apply ink to the corresponding ink roll, which selectively apply ink to the print roll, which prints on the blanks;

at least two applicator adjustment mechanisms, wherein one applicator adjustment mechanism is operatively connected to one ink applicator and the other applicator adjustment mechanism is operatively connected to the other ink applicator, wherein each ink applicator can be moved between an engaged position and a retracted position relative to the print roll in response to actuation of the corresponding applicator adjustment mechanism; and at least two primary actuators, wherein one primary actuator is operatively connected to one applicator adjustment mechanism and the other primary actuator is operatively connected to the other applicator adjustment mechanism.

3. The machine of claim 2, wherein one of the ink applicators can be disposed in the engaged position for printing while at the same time another one of the ink applicators can be disposed in the retracted position for cleaning.

4. The machine of claim 3, wherein each ink chamber mechanism comprises a support member, an ink well coupled to the support member, and two or more blades extending from the ink well and contacting the corresponding ink roll for applying ink to the ink roll.

5. The machine of claim 4, wherein each ink chamber mechanism further comprises a pivotal member that is coupled to the corresponding support member and that supports and permits a pivotal movement of the ink well, wherein the ink well can be pivoted away from the corresponding ink roll for accessing the ink well.

6. The machine of claim 3, wherein each ink chamber mechanism comprises a support member and an ink well coupled thereto and disposed proximate to the corresponding ink roll, the support member slidably coupled to the frame and rotationally coupled to the corresponding ink roll, applicator adjustment mechanism, or machine frame, wherein the ink chamber mechanism moves together with the ink roll.

7. The machine of claim 2, further comprising at least two travel limiting mechanisms and at least two secondary actuators, wherein one travel limiting mechanism is operatively connected to one primary actuator to limit the rotation of the corresponding adjusting shaft and operatively connected to and driven by one of the secondary actuators, and another travel limiting mechanism is operatively connected to another primary actuator to limit the rotation of the corresponding adjusting shaft and operatively connected to and driven by another secondary actuator.

8. The machine of claim 7, wherein each of the travel limiting mechanisms comprises an axial member that movably extends into the corresponding primary actuator to limit the rotation of corresponding adjusting shaft, a first pinion gear mounted to or formed onto the axial member, and a second pinion gear connected to and driven by the corresponding secondary actuator and meshing with the first pinion gear.

9. The machine of claim 8, wherein each of the secondary actuators is provided by an incremental rotary actuator for delivering a rotary motion to the second pinion gear in discrete increments or steps.

10. A printing machine, comprising:

at least one rotary print roll;

at least two ink applicators for each print roll that are independently operable so that one of the ink applicators can be disposed in an engaged position for printing while at the same time another one of the ink applicators can be disposed in a retracted position for cleaning.

11. The machine of claim 10, further comprising an applicator adjustment mechanism for each ink applicator, wherein each of the applicator adjustment mechanisms comprises a pivot arm with the corresponding ink applicator coupled thereto and an actuator operatively coupled to the pivot arm, wherein each ink applicator can be pivoted between the engaged position and the retracted position relative to the print roll in response to actuation of the corresponding applicator adjustment mechanism.

12. The machine of claim 10, further comprising an applicator adjustment mechanism comprising a pivot arm with the at least two ink applicators coupled thereto, an actuator operatively coupled to the pivot arm, and a stop mechanism having a cam that engages and limits the travel of the pivot arm, wherein each ink applicator can be pivoted between the engaged position and the retracted position relative to the print roll in response to actuation of the actuator.

13. A machine for operating on blanks, comprising:

a machine frame;

at least one impression member supported by the frame;

at least one rotary print roll supported by the frame and disposed proximate to the impression member, wherein the impression member and the print roll define therebetween a nip for receiving the blanks in series and transporting the blanks through the machine;

at least two ink applicators for each print roll, each ink applicator comprising a rotary ink roll and an ink chamber mechanism disposed adjacent the ink roll, with each ink roll disposed proximate to the print roll and each ink applicator supported by the frame, wherein the ink chambers apply ink to the corresponding ink roll, which selectively apply ink to the print roll, which prints on the blanks; and at least two clutches and at least two motors, wherein one clutch is coupled to one applicator adjustment mechanism and one motor is coupled to the one clutch for rotating the corresponding ink roll independently of the rotary main drive mechanism, and wherein another clutch is coupled to another applicator adjustment mechanism and another motor is coupled to the other clutch for rotating the corresponding ink roll independently of the rotary main drive mechanism.

14. A machine for operating on blanks, comprising:

a machine frame;

a feed mechanism having at least two feed rolls supported by the frame, wherein the feed rolls draw each of the blanks from a stack of blanks into the machine and transport the blanks in series through the machine;

a plurality of print mechanisms each supported by the frame, each print mechanism comprising a rotary impression roll, a rotary print roll, and at least two ink applicators for each print roll, wherein the impression roll and the print roll define therebetween a nip for receiving the blanks in series and transporting the blanks through the machine, wherein each ink applicator comprises a rotary ink roll and an ink chamber mechanism, wherein the ink roll of each print mechanism has a different textured surface matrix relative to each other ink roll of the same print mechanism, wherein each ink chamber mechanism comprises a support member, an ink well pivotally coupled to the support member, and two or more blades extending from the ink well and contacting the ink roll for applying ink to the ink roll, the support member slidably coupled to the frame and rotationally coupled to the corresponding ink roll, applicator adjustment mechanism, or machine frame;

at least two applicator adjustment mechanisms for selectively moving the ink applicators between an engaged position contacting the corresponding print roll and a retracted position, wherein one applicator adjustment mechanism is operatively coupled to one ink applicator and the other applicator adjustment mechanism is operatively coupled to the other ink applicator;

at least two primary actuators, wherein one primary actuator is operatively connected to one applicator adjustment mechanism and the other primary actuator is operatively connected to the other applicator adjustment mechanism;

at least two travel limiting mechanisms, wherein one travel limiting mechanism is operatively connected to one primary actuator to limit the movement of the corresponding ink applicator, and another travel limiting mechanism is operatively connected another primary actuator to limit the movement of the corresponding ink applicator, wherein each of the travel limiting mechanisms comprises an axial member that movably extends into the corresponding primary actuator, a first pinion gear mounted to or formed onto the axial member, and a second pinion gear meshing with the first pinion gear;

at least two secondary actuators, wherein one secondary actuator is operatively connected to and drives the second pinion gear of one travel limiting mechanism, and another secondary actuator is operatively connected to and drives the second pinion gear of another travel limiting mechanism, wherein each of the secondary actuators is provided by an incremental rotary actuator for delivering a rotary motion to the corresponding second pinion gear in discrete increments or steps;

a cutter mechanism having at least one cutter roll and at least one anvil roll supported by the frame, wherein the cutter roll and the anvil roll operate to cut or score the blanks; and a rotary main drive supported by the frame, wherein the drive rotationally drives the feed mechanism, the print mechanism, and the cutter mechanism.

15. The machine of claim 14, further comprising at least two clutches and at least two motors, wherein one clutch is coupled to one applicator adjustment mechanism and one motor is coupled to the one clutch for rotating the corresponding ink roll independently of the rotary main drive mechanism, and wherein another clutch is coupled to another applicator adjustment mechanism and another motor is coupled to the other clutch for rotating the corresponding ink roll independently of the rotary main drive mechanism.

16. The machine of claim 14, wherein the rotary main drive comprises:

a rotary feed drive having a rotary power source operatively connected to one of the feed rolls, and at least one rotary feed transmission shaft operatively connected to the rotary powered feed roll;

a plurality of rotary print drives, with one print drive for each print mechanism, each print drive having at least one rotary print transmission shaft that rotationally drives the corresponding impression roll and ink rolls;

a rotary cutter drive having at least one rotary cutter transmission shaft that rotationally drives the cutter roll and the anvil roll; and a plurality of separable couplings for operatively connecting the feed drive, the print drives, and the cutter drive, wherein one of the separable couplings operatively connects the feed transmission shaft to one of the print transmission shafts and another one of the separable couplings operatively connects the cutter transmission shaft to one of the print transmission shafts.

17. The machine of claim 16, further comprising a registration adjustment mechanism having a differential gear-set operatively connected to the main drive and a gearmotor operatively connected to the differential gear-set, wherein a rate of rotation of the print roll changes upon actuation of the gearmotor.

18. The machine of claim 14, further comprising a vacuum transfer mechanism comprising a suction mechanism, a vacuum housing in communication with the suction mechanism and having openings defined therein, and one or more transfer rollers disposed in the housing with a portion of at least one of the transfer rollers extending through at least one of the openings for contacting and transferring the blanks through the machine.

19. A modular print section for a machine for operating on blanks, the modular print section comprising:

a print section frame;

a rotary impression roll supported by the print section frame;

a rotary print roll supported by the print section frame and disposed proximate to the impression roll, wherein the impression roll and the print roll define therebetween a nip for receiving the blanks in series and transporting the blanks through the print section;

at least two ink applicators supported by the print section frame and disposed proximate to the print roll, each ink applicator comprising a rotary ink roll and an ink chamber mechanism disposed adjacent the ink roll, each ink roll disposed proximate to the print roll, wherein the ink chambers apply ink to the corresponding ink roll, which selectively apply ink to the print roll, which prints on the blanks; and a rotary print drive supported by the print section frame, wherein the print drive rotationally drives the impression roll, the print roll, and the ink roll, the print drive having a rotary print transmission shaft having an input end for operatively connecting to a preceding transmission shaft output end of a preceding section of the machine, and having an output end for operatively connecting to a subsequent transmission shaft input end of a subsequent section of the machine.

20. The print section of claim 19, wherein the print drive further comprises an impression roll sprocket coupled to the impression roll, an ink roll sprocket coupled to the ink roll, a print drive sprocket, at least one belt interconnecting the impression roll sprocket, the ink roll sprockets, and the print drive sprocket, and a direction changing gear-set operatively connected to the drive sprocket and the print transmission shaft.

21. The print section of claim 19, further comprising a separable input coupling for operatively connecting the input end of the print transmission shaft to the preceding transmission shaft output end of the preceding feed or print section of the machine, and a separable output coupling for operatively connecting the output end of the print transmission shaft to the subsequent transmission shaft input end of the subsequent print or cutter section of the machine.

22. The print section of claim 19, further comprising at least one applicator adjustment mechanism operatively coupled to the ink applicators, wherein the applicator adjustment mechanism is operable to move the ink applicators between an engaged position contacting the corresponding print roll and a retracted position.

23. The print section of claim 22, wherein each ink chamber mechanism comprises a support member and an ink well coupled thereto and disposed proximate to the corresponding ink roll, the support member slidably coupled to the frame and rotationally coupled to the corresponding ink roll, applicator adjustment mechanism, or frame, wherein the ink roll and the ink chamber mechanism move together between the engaged and retracted positions in response to actuation of the corresponding applicator adjustment mechanism.

24. The print section of claim 19, further comprising a track and a least one roller bearing supported by the track and supporting the print section frame, wherein the print section frame is movable relative to the track.

25. The print section of claim 19, further comprising a registration adjustment mechanism having a differential gear-set operatively connected to the print transmission shaft and a gearmotor operatively connected to the differential gear-set, wherein a rate of rotation of the print roll changes upon actuation of the gearmotor.

26. The modular print section of claim 19, wherein one of the ink applicators can be disposed in an engaged position for printing while at the same time another one of the ink applicators can be disposed in a retracted position for cleaning.

27. A machine for operating on blanks, comprising:

a machine frame;

at least one rotary impression roll supported by the frame;

at least one rotary print roll supported by the frame and disposed proximate to the impression roll, wherein the impression roll and the print roll define therebetween a nip for receiving the blanks in series and transporting the blanks through the machine;

at least one ink applicator supported by the frame and disposed proximate to the print roll, wherein the ink applicator has an ink roll, wherein the ink applicator is adapted to apply ink to the print roll and the print roll is adapted to print on the blanks;

at least one rotary print drive supported by the frame, wherein the print drive comprises a rotary print transmission shaft operatively connected to and rotationally driving the impression roll, the print roll, and the ink roll, wherein the print drive further comprises a first direction changing gear-set operatively connected to the print transmission shaft, a print roll sprocket coupled to the print roll, a first print drive sprocket, and a first print belt interconnecting the first print drive sprocket and the print roll sprocket; and a print registration adjustment mechanism having a differential gear-set operatively connected to the first direction changing gear-set and to the first print drive sprocket and a gearmotor operatively connected to the differential gear-set, wherein a rate of rotation of the print roll changes upon actuation of the gearmotor.

28. The machine of claim 27, wherein the print drive further comprises a second direction changing gear-set operatively connected to the print transmission shaft, a connector shaft operatively connected to the second direction changing gear-set, a second print drive sprocket operatively connected to the connector shaft, an impression roll sprocket coupled to the impression roll, two ink roll sprockets with each ink roll sprocket coupled to one of the ink rolls, and a second print belt interconnecting the second drive sprocket, the impression roll sprocket, and the ink roll sprockets.

29. The machine of claim 27, further comprising at least two clutches and at least two motors, wherein one clutch is coupled to one applicator adjustment mechanism and one motor is coupled to the one clutch for rotating the corresponding ink roll independently of the rotary main drive mechanism, and wherein another clutch is coupled to another applicator adjustment mechanism and another motor is coupled to the other clutch for rotating the corresponding ink roll independently of the rotary main drive mechanism.

* * * * *